US006377191B1

(12) United States Patent
Takubo

(10) Patent No.: US 6,377,191 B1
(45) Date of Patent: Apr. 23, 2002

(54) SYSTEM FOR ASSISTING TRAFFIC SAFETY OF VEHICLES

(75) Inventor: Masayuki Takubo, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 0 days.

(21) Appl. No.: 09/576,414

(22) Filed: May 22, 2000

(30) Foreign Application Priority Data

May 25, 1999 (JP) ..... 11-145198

(51) Int. Cl.[7] ..... G08G 1/017
(52) U.S. Cl. ..... 340/937; 340/933; 340/938
(58) Field of Search ..... 340/436, 901, 340/903, 933, 937, 907, 435, 911; 701/118, 120, 123, 211, 213

(56) References Cited

U.S. PATENT DOCUMENTS

| | | | | | |
|---|---|---|---|---|---|
| 4,814,765 | A | * | 3/1989 | DeRoche et al. | 340/915 |
| 5,204,536 | A | * | 4/1993 | Vardi | 250/551 |
| 5,343,206 | A | * | 8/1994 | Ansaldi et al. | 342/70 |
| 5,396,429 | A | * | 3/1995 | Hanchett | 340/910 |
| 5,530,441 | A | * | 6/1996 | Takatou et al. | 340/937 |
| 5,617,085 | A | * | 4/1997 | Tsutsumi et al. | 340/903 |
| 5,646,612 | A | * | 7/1997 | Byon | 340/903 |
| 5,646,853 | A | * | 7/1997 | Takahashi et al. | 340/911 |
| 5,677,979 | A | * | 10/1997 | Squicciarini et al. | 386/46 |
| 5,793,308 | A | * | 8/1998 | Rosinski et al. | 340/903 |
| 5,892,461 | A | * | 4/1999 | Dokko | 340/907 |

FOREIGN PATENT DOCUMENTS

| | | | |
|---|---|---|---|
| DE | A1-4042258 | | 9/1991 |
| DE | A1-19546391 | | 6/1996 |
| EP | 0841648 | A2 | 5/1998 |
| FR | A1-2562694 | | 10/1985 |
| GB | 2248994 | A | 4/1992 |
| JP | 5-297141 | | 11/1993 |
| JP | A-06-318295 | | 11/1994 |
| JP | 7-127022 | | 5/1995 |
| JP | 9-185800 | | 7/1997 |
| JP | 9-282592 | | 10/1997 |
| JP | A-11086192 | | 3/1999 |

* cited by examiner

*Primary Examiner*—Van T Trieu
(74) *Attorney, Agent, or Firm*—Staas & Halsey LLP

(57) ABSTRACT

A system for assisting the traffic safety of vehicles for improving the visibility, including a camera monitoring the road of an oncoming lane of a vehicle making a right turn at an intersection; a display board placed at a position above the road leading up to the intersection in a manner visible to the driver of the vehicle; a control device for control so that the image of the road obtained by the camera is displayed on the display board, a near infra-red illumination unit for illuminating the road so as to enable an image of the road to be obtained by the camera and so as not to temporarily blind the drivers of the vehicles on the road, an image recognizing device for recognizing an object moving on the road approaching the intersection based on the image of the road obtained by the camera, a radar for emitting a radar wave to an object moving on the road approaching the intersection to obtain information on the position and speed of the moving object from the reflected wave, and a vehicle-mounted voice output device for voice output of the information drawing the attention of the driver.

48 Claims, 17 Drawing Sheets

SYSTEM FOR ASSISTING TRAFFIC SAFETY OF VEHICLES

BACKGROUND OF THE INVENTION

1. Field of the Invention

The present invention relates to a system for assisting the traffic safety of vehicles and a storage medium for the same, more particularly relates to a system for assisting the traffic safety of vehicles improving the visibility of oncoming vehicles to a vehicle turning right at an intersection or improving the front or rear visibility of a vehicle and a storage medium for the same.

2. Description of the Related Art

In recent years, various systems have been proposed using electronic apparatuses for notifying drivers of danger to assist traffic safety.

Ordinarily, at an intersection, red, yellow, and green traffic lights are used to control the flow of pedestrians and vehicles. In countries where drivers drive on the left-hand side of the road, like the United Kingdom and Japan, a vehicle attempting to make a right turn at an intersection (left turn in the case of countries where drivers drive on the right-hand side of the road, same below), however, sometimes cannot see other vehicle from an oncoming lane which is hidden by another vehicle attempting to make a right turn from the same oncoming lane. If that other vehicle proceeds straight, the right turn could result in a collision.

The apparatus and method for warning a right turning vehicle of an oncoming vehicle at an intersection disclosed in Japanese Unexamined Patent Publication (Kokai) No. 9-282592 provide sensors arranged at predetermined intervals at the sides of the roads leading up to the intersection to detect if there are any obstacles on the roads leading up to the intersections and transmitters arranged at the sides of the roads and connected to the sensors. When a sensor detects that a traffic light becomes green or yellow for a vehicle attempting to make a right turn at the intersection and that there is an obstacle in the oncoming lane of the vehicle leading up to the intersection, a radio warning signal is sent from the transmitter to a receiver mounted in the vehicle to notify the driver of the vehicle of the existence of a vehicle proceeding straight on the oncoming lane.

On the other hand, there is a vehicle-mounted object detector disclosed in Japanese Unexamined Patent Publication (Kokai) No. 5-297141 for improving the front or rear visibility of a vehicle. This apparatus is provided with an imaging means for monitoring objects outside the vehicle, a recognizing means for recognizing predetermined image information in image information obtained by the imaging means, a coordinate detecting means for detecting the positional coordinates of the predetermined image information, an object detecting means for emitting a near infra-red beam, receiving the light reflected from the object, and detecting the information of the object by this, and a control means for controlling the direction of emission and/or direction of reception of light from the object detecting means based on the positional coordinate information from the coordinate detecting means, detects information on the distance to the object at a high precision, and thereby easily ensures safe driving.

Summarizing the problem to be solved by the invention, the apparatus disclosed in Japanese Unexamined Patent Publication (Kokai) No. 9-282592 cannot detect a vehicle entering an intersection from a location away from the intersection unless a large number of sensors are provided at predetermined intervals at the sides of the road leading up to the intersection, so there is the problem that it is inadequate for informing the driver of a vehicle of the presence of a vehicle proceeding straight on the oncoming lane.

On the other hand, the apparatus disclosed in Japanese Unexamined Patent Publication (Kokai) No. 5-297141 emits a beam of light from a point light source to an object outside the vehicle to detect the information on the distance to the object and therefore has the problem that it cannot recognize objects in a broad range to the front and rear of the vehicle.

SUMMARY OF THE INVENTION

An object of the present invention is to solve the above problems and provide a system for assisting the traffic safety of vehicles improving the visibility of an oncoming vehicle to a vehicle making a right turn at an intersection or improving the front or rear visibility of the vehicle and a storage medium for the same.

To attain the above object, according to the present invention, there is provided a system for assisting the traffic safety of vehicles improving the visibility by providing a camera for monitoring the road of an oncoming lane of a vehicle making a right turn at an intersection, a display board placed at a position above the road leading up to the intersection visible to the driver of the vehicle, and a control means for control so as to display an image of the road obtained by the camera on the display board.

More preferably, provision is made of a near infrared illumination unit illuminating the road so as to enable an image of the road to be obtained by the camera and so as not to temporarily blind the drivers of the vehicles on the road, an image recognizing means for recognizing an object moving on the road approaching the intersection based on the image of the road obtained by the camera, a radar for emitting a radar wave to the object moving on the road approaching the intersection and obtaining information on the position and speed of the moving object from the reflected wave, and a vehicle-mounted voice output means for voice output of information drawing the attention of the driver.

BRIEF DESCRIPTION OF THE DRAWINGS

The above object and features of the present invention will be more apparent from the following description of the preferred embodiments given with reference to the accompanying drawings, wherein.

DESCRIPTION OF THE PREFERRED EMBODIMENTS

Figure 1:
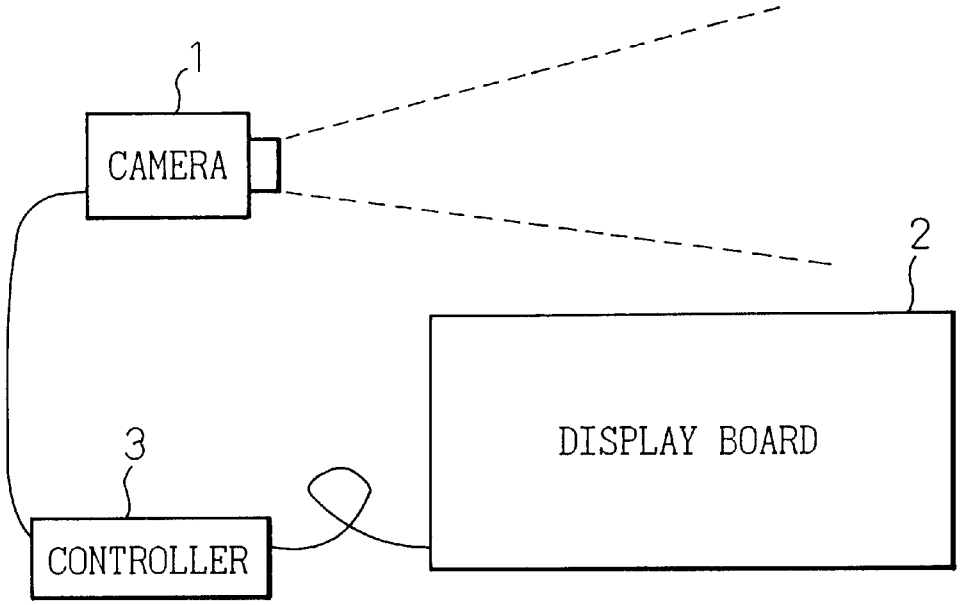
FIG. 1 is a block diagram of the configuration of a first embodiment of the present invention.

First, a description will be given of the gist of aspects according to the concept of the present invention.

According to a first aspect of the present invention, there is provided a system for assisting the traffic safety of vehicles provided with an imaging means for monitoring the road of an oncoming lane of a vehicle making a right turn at an intersection; a display board placed at a position above the road leading up to the intersection in a manner visible to the driver of the vehicle; and a control means for control so that the image of the road obtained by the imaging means is displayed on the display board.

According to a second aspect of the present invention, there is provided the system for assisting the traffic safety of vehicles of the first aspect further provided with a near infra-red illuminating means for illuminating the road so as to enable an image of the road to be obtained by the imaging means and so as not to temporarily blind the drivers of the vehicles on the road.

According to a third aspect of the present invention, there is provided the system for assisting the traffic safety of vehicles of the first aspect further provided with an image recognizing means for recognizing an object moving on the road approaching the intersection based on the image of the road obtained by the imaging means, and the control means displays the image of the moving object recognized by the image recognizing means on the display board.

According to a fourth aspect of the present invention, there is provided the system for assisting the traffic safety of vehicles of the first aspect further provided with a radar type vehicle information detecting means for emitting a radar wave to an object moving on the road approaching the intersection to obtain information on the position and speed of the moving object from the reflected wave, and the control means displays the information on the position and speed of the moving object detected by the radar type vehicle information detecting means on the display board.

According to a fifth aspect of the present invention, there is provided the system for assisting the traffic safety of vehicles of the first aspect wherein the control means analyzes the position and speed of the moving object detected by the radar type vehicle information detecting means and displays information drawing the attention of the driver on the display board when it is judged that the moving object is liable to contact the vehicle.

According to a sixth aspect of the present invention, there is provided the system for assisting the traffic safety of vehicles of the first aspect further provided with a voice (including general sound, same below) output means placed near the display board for voice output of the information drawing the attention of the driver.

According to a seventh aspect of the present invention, there is provided a system for assisting the traffic safety of vehicles improving the visibility of a right turning vehicle including an imaging means for monitoring the road of an oncoming lane of a vehicle making a right turn at an intersection, a display means mounted in the vehicle, and a communications control means for radio communication between the imaging means and the display means and for control for display of the image of the road obtained from the imaging means on the screen of the display board.

According to an eighth aspect of the present invention, there is provided the system for assisting the traffic safety of vehicles of the seventh aspect further provided with a near infra-red illuminating means for illuminating the road so as to enable an image of the road to be obtained by the imaging means and so as not to temporarily blind the drivers of the vehicles on the road.

According to a ninth aspect of the present invention, there is provided the system for assisting the traffic safety of vehicles of the seventh aspect further provided with an image recognizing means for recognizing an object moving on the road approaching the intersection based on the image of the road obtained by the imaging means, and the communication control means displays the image of the moving object recognized by the image recognizing means on the display board.

According to a 10th aspect of the present invention, there is provided the system for assisting the traffic safety of vehicles of the seventh aspect further provided with a radar type vehicle information detecting means for emitting a radar wave to the moving object on the road approaching the intersection to obtain information on the position and speed of the moving object from the reflected wave, and the communication control means displays the information on the position and speed of the moving object detected by the radar type vehicle information detecting means on the display board.

According to an 11th aspect of the present invention, there is provided the system for assisting the traffic safety of vehicles of the seventh aspect wherein the communication control means analyzes the position and speed of the moving object detected by the radar type vehicle information detecting means and displays information drawing the attention of the driver on the display board when it is judged that the moving object is liable to contact the vehicle.

According to a 12th aspect of the present invention, there is provided the system for assisting the traffic safety of vehicles of the seventh aspect further provided with a voice output means mounted in the vehicle for voice output of information drawing the attention of the driver.

According to a 13th aspect of the present invention, there is provided a system for assisting the traffic safety of vehicles improving the front visibility of a vehicle including a near infra-red illumination unit provided at a light source for a high beam of a headlight illuminating the road in front of the vehicle, or near it, for emitting light to substantially the area illuminated by the high beam, a near infra-red camera provided at the front end of the vehicle for monitoring the road in front of the vehicle illuminated by the near infra-red illumination unit, and a display means for displaying the image of the road in front of the vehicle obtained by the near infra-red camera.

According to a 14th aspect of the present invention, there is provided a system for assisting the traffic safety of vehicles of the 13th aspect further provided with an image recognizing means for recognizing an object moving on the road leading up to the intersection based on the image obtained by the near infra-red camera, and the display means displays the image of the moving object recognized by the image recognizing means on the screen of the display means.

According to a 15th aspect of the present invention, there is provided the system for assisting the traffic safety of vehicles of the 14th aspect wherein the display means analyzes the position and speed of the moving object based on the data of the image of the moving object recognized by the image recognizing means and displays information drawing the attention of the driver on the screen of the display means when judging that the moving object is liable to contact the vehicle.

According to a 16th aspect of the present invention, there is provided the system for assisting the traffic safety of vehicles of the 15th aspect further provided with a voice output means mounted in the vehicle for voice output of the information drawing the attention of the driver.

According to a 17th aspect of the present invention, there is provided a system for assisting the traffic safety of vehicles of the 13th aspect further provided with a visible light camera placed at the front end of the vehicle and monitoring the road in front of the vehicle illuminated by the high beam of the headlight, and the display means displays a color image of the road in front of the vehicle obtained from the visible light camera.

According to an 18th aspect of the present invention, there is provided a system for assisting the traffic safety of vehicles improving the rear visibility of a vehicle including a near infra-red illumination unit provided near the light source of a tail light illuminating the road to the rear of a vehicle for emitting light to the road to the rear of the vehicle, a near infra-red camera provided at the rear end of the vehicle so as to monitor the road to the rear of the vehicle illuminated by the near infra-red illumination unit, and a display means for displaying an image of the road to the rear of the vehicle obtained from the near infra-red camera.

According to a 19th aspect of the present invention, there is provided a system for assisting the traffic safety of vehicles of the 18th aspect further provided with an image recognizing means for recognizing a moving object on a road at the rear of the vehicle based on the image obtained by the near infra-red camera, and the display means displays the image of the moving object recognized by the image recognizing means on the screen of the display means.

According to a 20th aspect of the present invention, there is provided a system for assisting the traffic safety of vehicles of the 19th aspect wherein the display means analyzes the position and speed of the moving object based on the data of the image of the moving object recognized by the image recognizing means and displays information drawing the attention of the driver on the screen of the display means when judging that the moving object is liable to contact the vehicle.

According to a 21st aspect of the present invention, there is provided the system for assisting the traffic safety of vehicles of the 20th aspect further provided with a voice output means mounted in the vehicle for voice output of the information drawing the attention of the driver.

According to a 22nd aspect of the present invention, there is provided a system for assisting the traffic safety of vehicles of the 18th aspect further provided with a visible light camera placed at the rear end of the vehicle so as to monitor the road to the rear of the vehicle illuminated by the near infra-red illumination unit, and the display means displays a color image of the road to the rear of the vehicle obtained by the visible light camera.

According to a 23rd aspect of the present invention, there is provided a computer readable storage medium used in a system for assisting the traffic safety of vehicles for improving the visibility of a right turning vehicle including an imaging means for monitoring the road of an oncoming lane of a vehicle making a right turn at an intersection and a display board provided at a position above the road leading up to the intersection visible to the driver of the vehicle, characterized by storing a program for making a computer function as a control means for control so as to display an image of the road obtained by the imaging means on the display board.

According to a 24th aspect of the present invention, there is provided a computer readable storage medium used in a system for assisting the traffic safety of vehicles for improving the visibility of a right turning vehicle including an imaging means for monitoring the road of an oncoming lane of a vehicle making a right turn at the intersection and a display means mounted in a vehicle, characterized by storing a program for making a computer function as a communication control means for control for radio communication between the imaging means and the display means and for display of the image of the road obtained by the imaging means on the screen of the display means.

According to a 25th aspect of the present invention, there is provided a computer readable storage medium used in a system for assisting the traffic safety of vehicles for improving the front visibility of a vehicle including a near infra-red illumination unit provided at the position of a light source, or near it, for the high beam of a headlight illuminating the front of the vehicle for emitting light to substantially the area illuminated by the high beam and a near infra-red camera provided at the front end of the vehicle so as to monitor the road in front of the vehicle illuminated by the near infra-red illumination unit, characterized by storing a program for making a computer function as a display means for displaying an image of the road in the front of the vehicle obtained from the near infra-red camera.

According to a 26th aspect of the present invention, there is provided a computer readable storage medium used in a system for assisting the traffic safety of vehicles for improving the rear visibility of a vehicle including a near infra-red illumination unit provided near a light source of a tail light illuminating the road to the rear of the vehicle for emitting light to the road to the rear of the vehicle and a near infra-red camera provided at the rear end of the vehicle for monitoring the road to the rear of the vehicle illuminated by the near infra-red illumination unit, characterized by storing a program for making a computer function as a display means for displaying an image of the road to the rear of the vehicle obtained from the near infra-red camera.

Below, a detailed explanation will be given of embodiments of the present invention with reference to the appended drawings. In the figures, the same reference numerals indicate the same components.

FIG. 1 to FIG. 13 are block diagrams of the configuration of first to 13th embodiments of the present invention.

First, an explanation will be given of systems for assisting the traffic safety of vehicles using display boards according to the first to sixth embodiments of the present invention with reference to FIG. 1 to FIG. 6.

As shown in FIG. 1, the system for assisting the traffic safety of vehicles according to the first embodiment of the present invention is provided with a camera (imaging means) 1 for monitoring the road of an oncoming lane of a vehicle making a right turn at an intersection, a display board 2 placed at a position above the road leading up to the intersection visible to the driver of a vehicle, and a controller (control means) 3 for control to display an image of the road obtained by the imaging means 1 on a display board 2.

Figure 2:
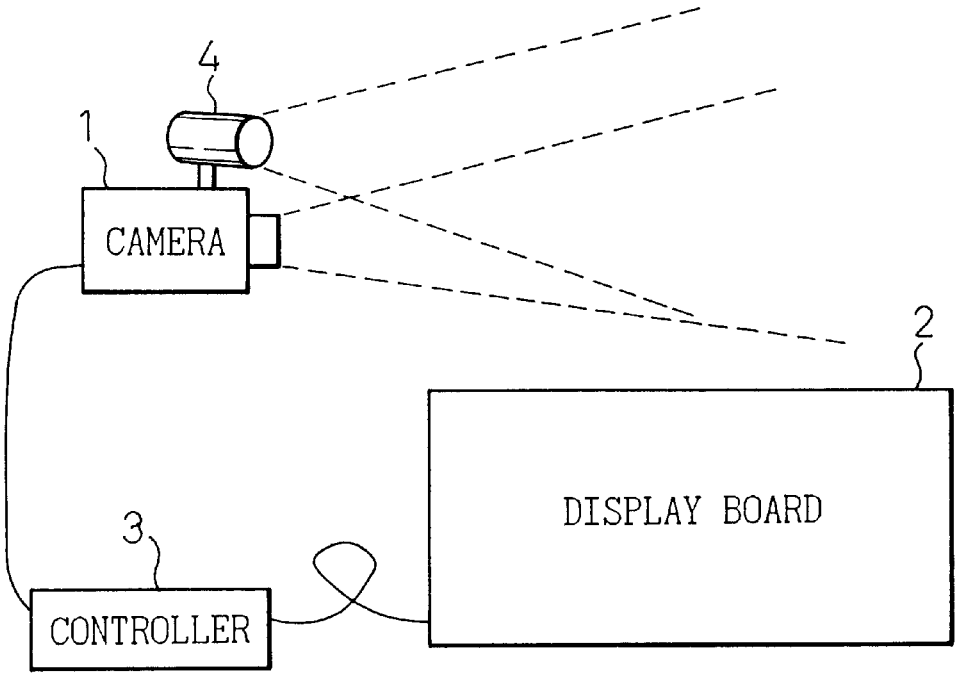
FIG. 2 is a block diagram of the configuration of a second embodiment of the present invention.

As shown in FIG. 2, the system for assisting the traffic safety of vehicles according to the second embodiment of the present invention is provided with, in addition to the components of the system of the first embodiment shown in FIG. 1, a near infra-red illumination unit 4 for illuminating the road so as to enable an image of the road to be obtained by the imaging means (camera) 1 and so as not to temporarily blind the driver of a vehicle on the road. The near infra-red illumination unit 4 is useful when the light is insufficient for the imaging means 1 to obtain an image of the road due to night, rain, etc. In the present embodiment, the near infra-red illumination unit 4 emits not continuous light, but discontinuous light and flashes light in synchronization with the shutter timing of the imaging means 1, for example, 30 frames/second. The near infra-red light is not visible to the human eye, but is visible to the imaging means 1.

Figure 3:
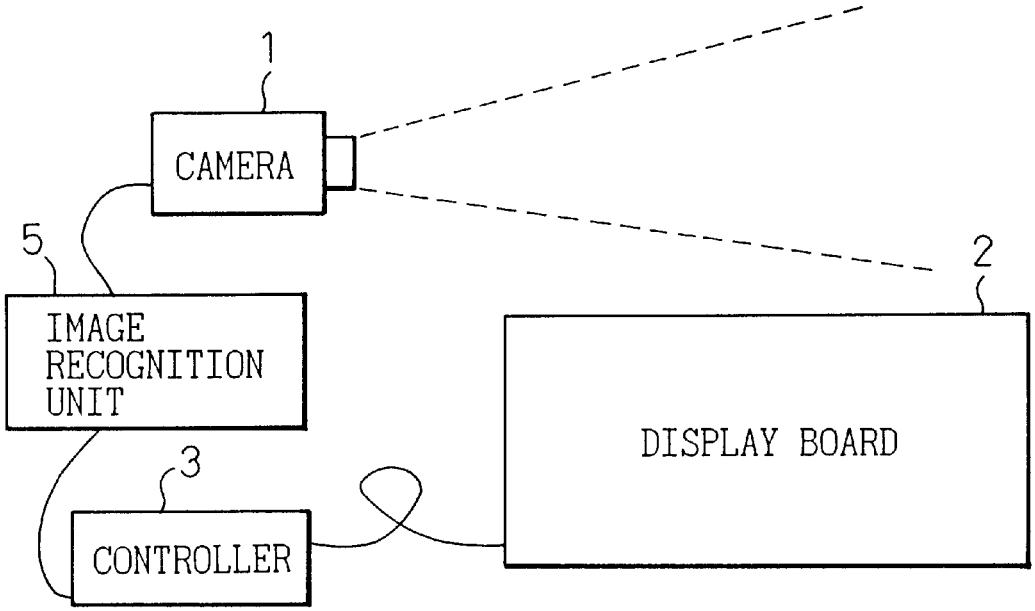
FIG. 3 is a block diagram of the configuration of a third embodiment of the present invention.

As shown in FIG. 3, the system for assisting the traffic safety of vehicles according to the third embodiment of the present invention is provided with, in addition to the components of the system of the first embodiment shown in FIG. 1, an image recognizing means 5 for recognizing an object moving on the road approaching the intersection based on the image of the road obtained by the imaging means 1. The control means 3 displays the image of the moving object recognized by the image recognizing means 5 on the display board 2. The image recognizing means 5 detects a moving object from the image obtained from the imaging means 1 by for example an edge detection technique.

Figure 4:
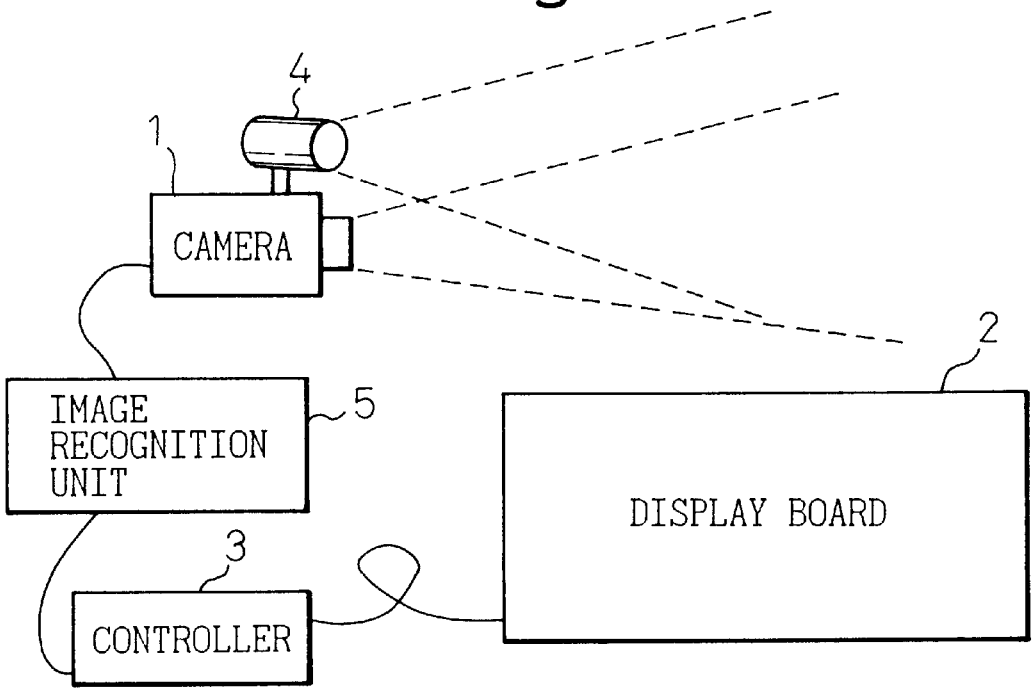
FIG. 4 is a block diagram of the configuration of a fourth embodiment of the present invention.

As shown in FIG. 4, the system for assisting the traffic safety of vehicles according to the fourth embodiment of the present invention is provided with, in addition to the components of the system of the second embodiment shown in FIG. 2, an image recognizing means 5 for recognizing an object moving on the road approaching the intersection based on the image of the road obtained by the imaging means 1. The control means 3 displays an image of the moving object recognized by the image recognizing means 5 on the display board 2.

Figure 5:
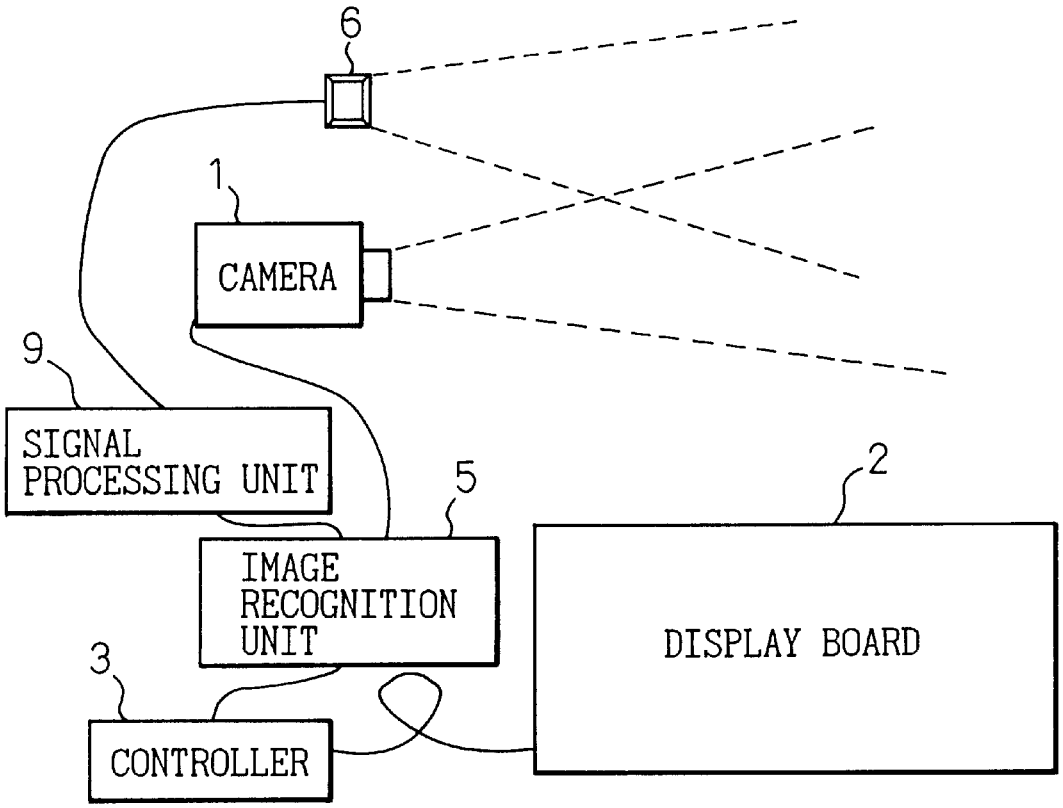
FIG. 5 is a block diagram of the configuration of a fifth embodiment of the present invention.

As shown in FIG. 5, the system for assisting the traffic safety of vehicles according to the fifth embodiment of the present invention is provided with, in addition to the components of the third embodiment shown in FIG. 3, a radar (radar type vehicle information detecting means) 6 for emitting a radar wave to an object moving on the road approaching the intersection and obtaining the information of the position and speed of the moving object from the reflected wave. The control means 3 displays the information of the position and speed of the moving object detected by the radar 6 on the display board 2 through the signal processing unit 9 connected to the radar 6.

Figure 6:
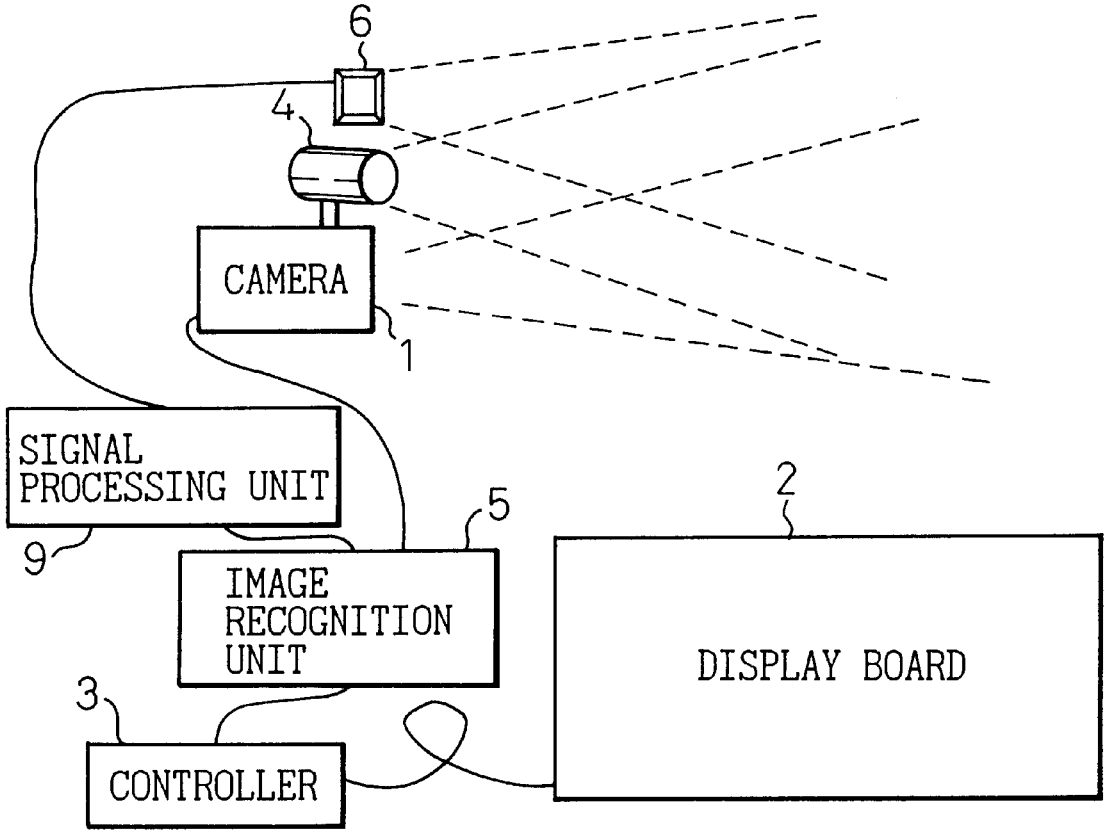
FIG. 6 is a block diagram of the configuration of a sixth embodiment of the present invention.

As shown in FIG. 6, the system for assisting the traffic safety of vehicles according to the sixth embodiment of the present invention is provided with, in addition to the components of the fourth embodiment shown in FIG. 4, a radar (radar type vehicle information detecting means) 6 for emitting a radar wave to an object moving on the road approaching the intersection and obtaining the information of the position and speed of the moving object from the reflected wave. The control means 3 displays the information of the position and speed of the moving object detected by the radar 6 on the display board 2 through the signal processing unit 9 connected to the radar 6. Further, the control means 3 analyzes the position and speed of the moving object detected by the radar 6 and displays information drawing the attention of the driver on the display board when it is judged that the moving object is liable to contact the vehicle.

Further, the systems for assisting the traffic safety of vehicles using a display board according to the first to sixth embodiments of the present invention shown in FIG. 1 to FIG. 6 are each provided with a voice output means (not shown) mounted in the vehicle for voice output of information drawing the attention of the driver.

Next, an explanation will be made of systems for assisting the traffic safety of vehicles using a vehicle-mounted display according to seventh to 13th embodiments of the present invention using FIG. 7 to FIG. 13.

Figure 7:
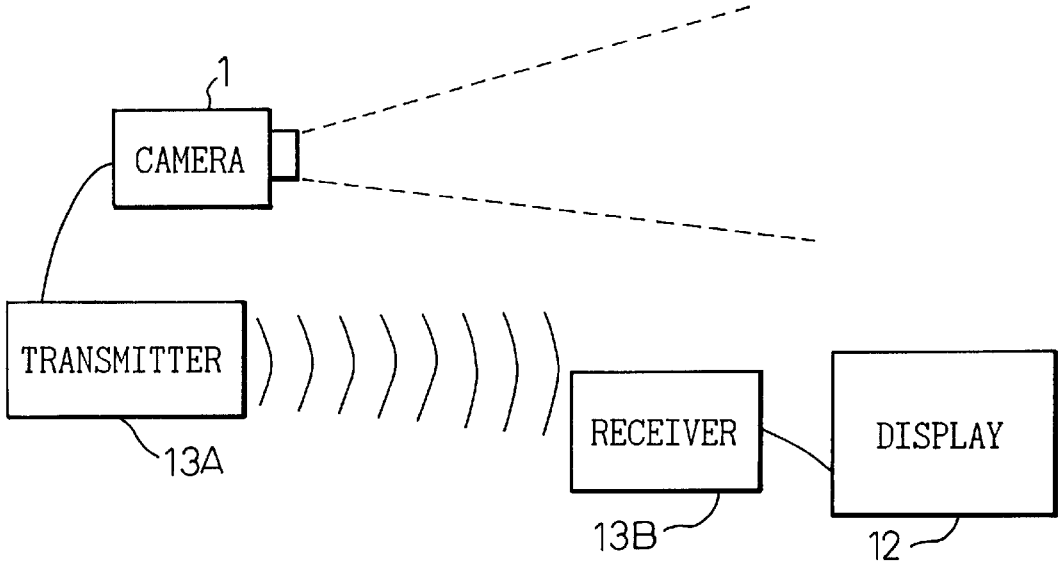
FIG. 7 is a block diagram of the configuration of a seventh embodiment of the present invention.

As shown in FIG. 7, the system for assisting the traffic safety of vehicles according to the seventh embodiment of the present invention is provided with a imaging means (camera) 1 for monitoring the road of an oncoming lane of a vehicle making a right turn at an intersection, a display (display means) 12 mounted in the vehicle, and a transmitter 13A and receiver 13B serving as radio communication control means for control to display the image of the road obtained by the imaging means 1 on the screen of the display means 12. The communication control means detects the timing of the right turn of the vehicle from a signal indicating operation of a turn switch and displays an image of the road of the oncoming lane on the display 12 mounted in the vehicle.

Figure 8:
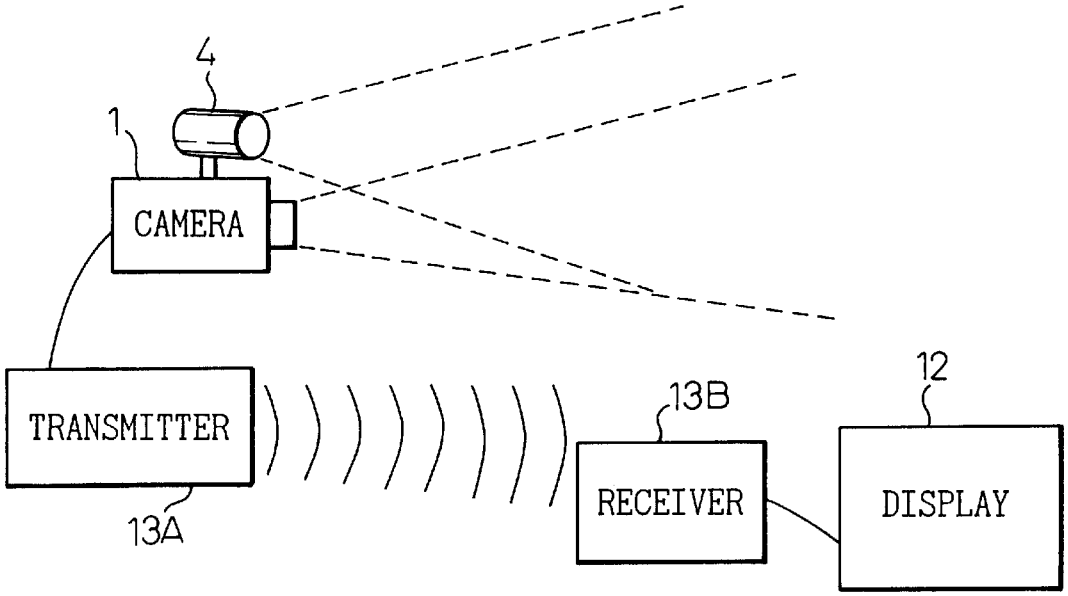
FIG. 8 is a block diagram of the configuration of an eighth embodiment of the present invention.

As shown in FIG. 8, the system for assisting the traffic safety of vehicles according to the eighth embodiment of the present invention is provided with, in addition to the components of the seventh embodiment shown in FIG. 7, a near infra-red illumination unit 4 for illuminating the road so as to enable an image of the road to be obtained by the imaging means 1 and so as not to temporarily blind the driver of a vehicle on the road. The near infra-red illumination unit 4 is useful when the light is insufficient for the imaging means 1 to obtain an image of the road due to night, rain, etc. In the present embodiment, the near infra-red illumination unit 4 emits not continuous light, but discontinuous light and flashes light in synchronization with the shutter timing of the imaging means 1, for example, 30 frames/second. The near infra-red light is not visible to the human eye, but is visible to the imaging means 1.

Figure 9:
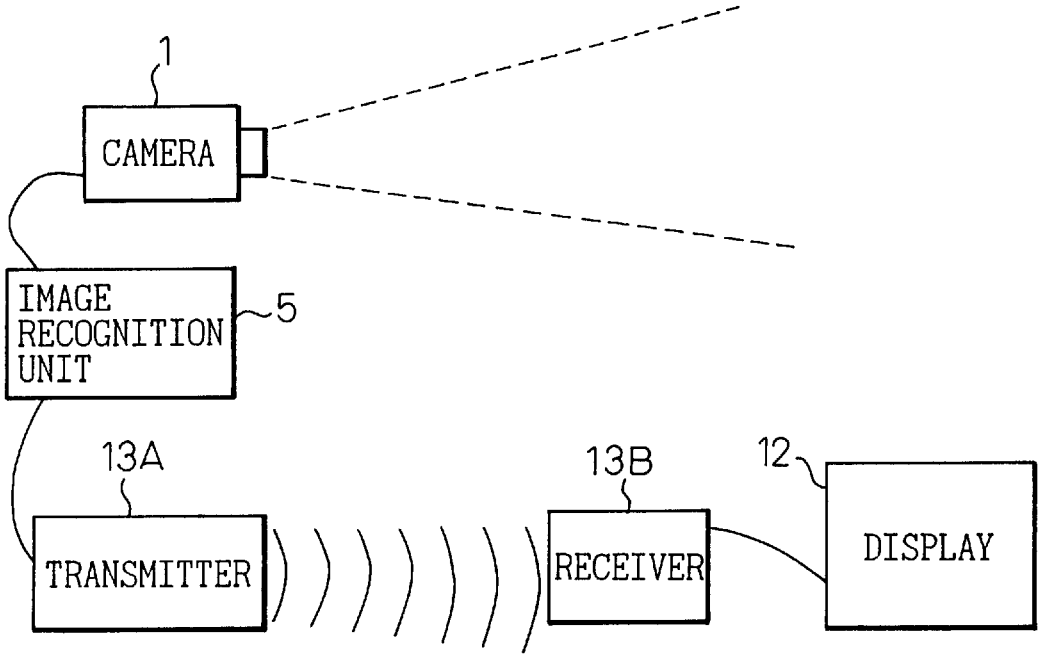
FIG. 9 is a block diagram of the configuration of a ninth embodiment of the present invention.

As shown in FIG. 9, the system for assisting the traffic safety of vehicles according to the ninth embodiment of the present invention is provided with, in addition to the components of the seventh embodiment shown in FIG. 7, an image recognizing means 5 for recognizing an object moving on the road approaching an intersection based on the image of the road obtained by the imaging means 1. The communication control means 13A and 13B display the image of the moving object recognized by the image recognizing means 5 on the screen of the display means 12. The image recognizing means 5 detects the moving object from the image obtained by the imaging means 1 by for example an edge detection technique.

Figure 10:
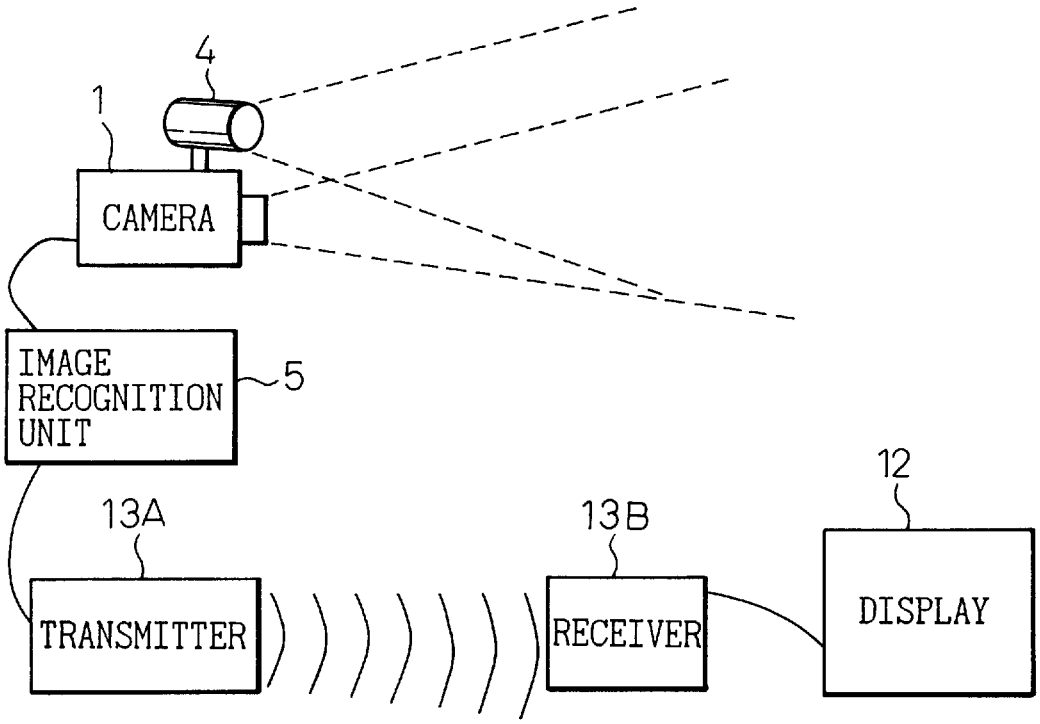
FIG. 10 is a block diagram of the configuration of a 10th embodiment of the present invention.

As shown in FIG. 10, the system for assisting the traffic safety of vehicles according to the 10th embodiment of the present invention is provided with, in addition to the components of the eighth embodiment shown in FIG. 8, an image recognizing means 5 for recognizing an object moving on the road approaching an intersection based on the image of the road obtained by the imaging means 1. The communication control means 13A and 13B display the image of the moving object recognized by the image recognizing means 5 on the screen of the display means 12.

Figure 11:
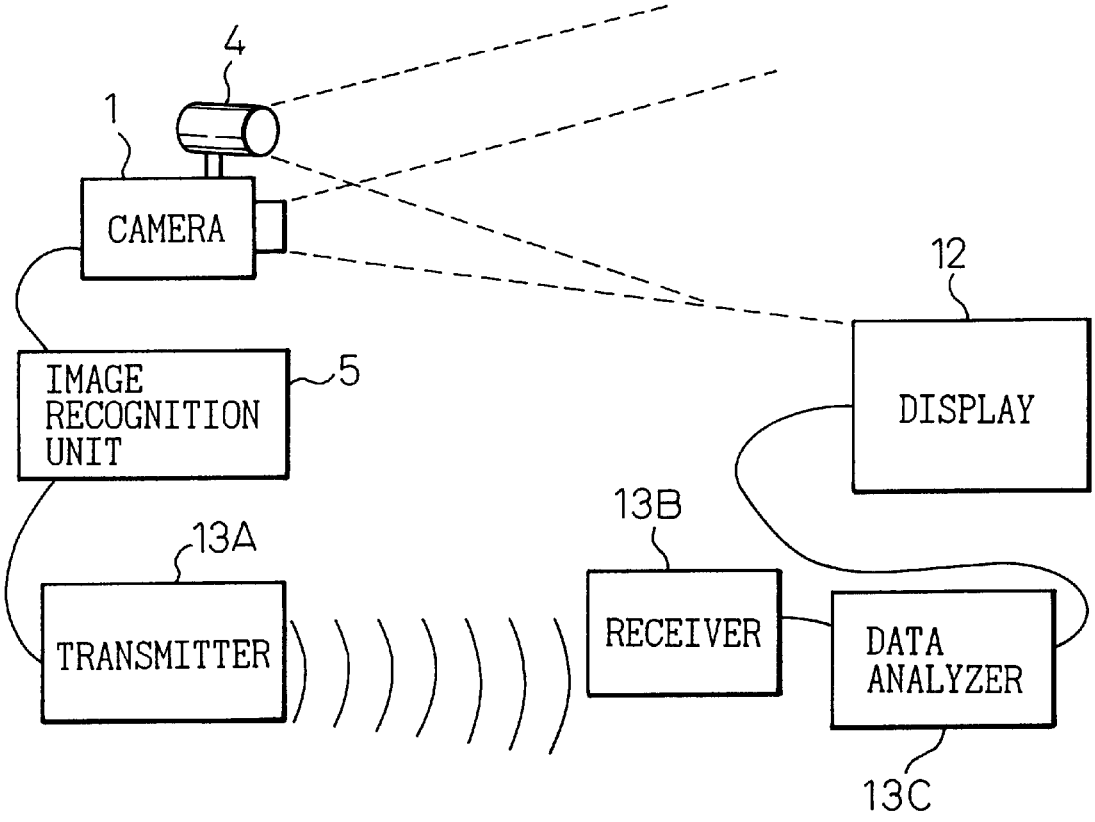
FIG. 11 is a block diagram of the configuration of an 11th embodiment of the present invention.

As shown in FIG. 11, the system for assisting the traffic safety of vehicles according to the 11th embodiment of the present invention is provided with, in addition to the components of the 10th embodiment shown in FIG. 10, the communication control means includes a data analyzer 13C. The data analyzer 13C judges if the moving object recognized by the image recognizing means 5 is liable to contact the vehicle. When judging it is liable to do so, it displays information drawing the attention of the driver on the screen of the display means 12.

Figure 12:
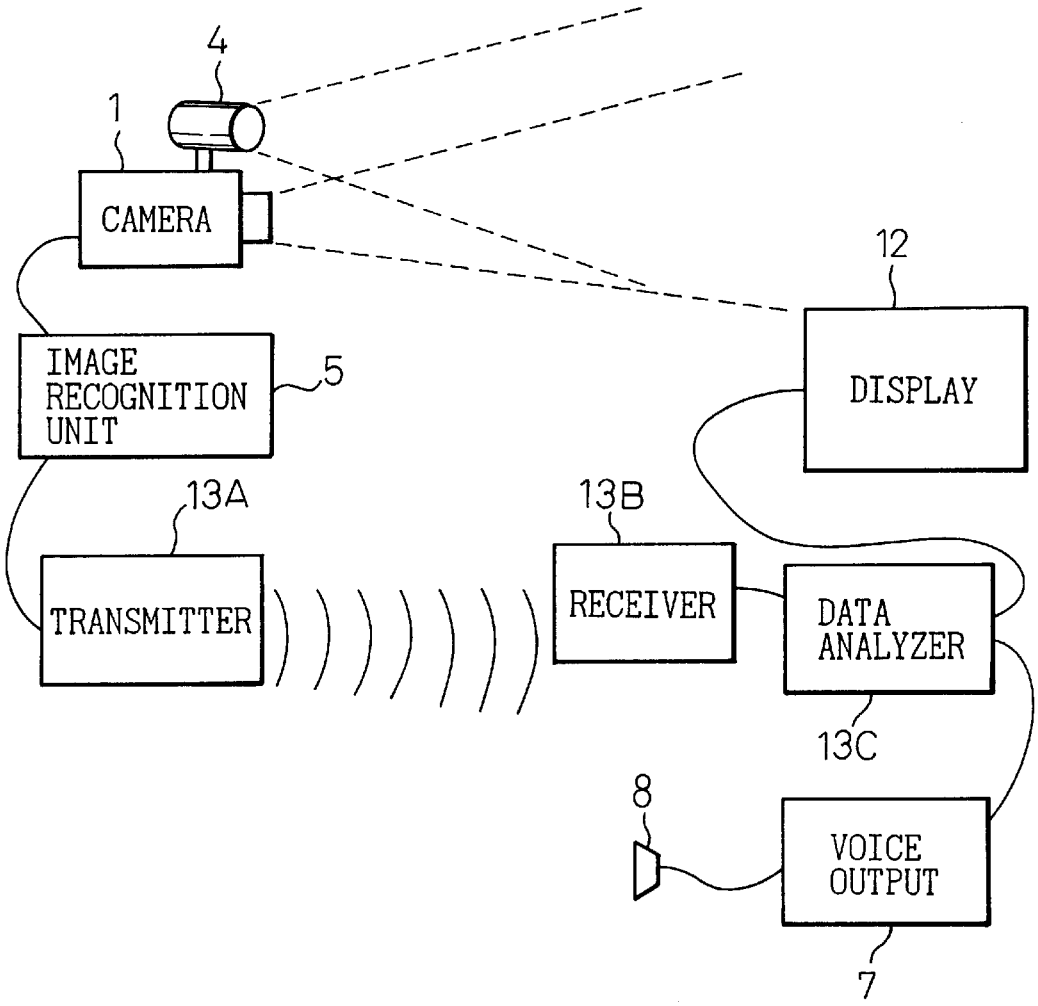
FIG. 12 is a block diagram of the configuration of a 12th embodiment of the present invention.

As shown in FIG. 12, the system for assisting the traffic safety of vehicles according to the 12th embodiment of the present invention is provided with, in addition to the components of the 11th embodiment shown in FIG. 11, a voice output means comprised of a voice output unit 7 and speaker 8 mounted in the vehicle for voice output of information drawing the attention of the driver.

Figure 13:
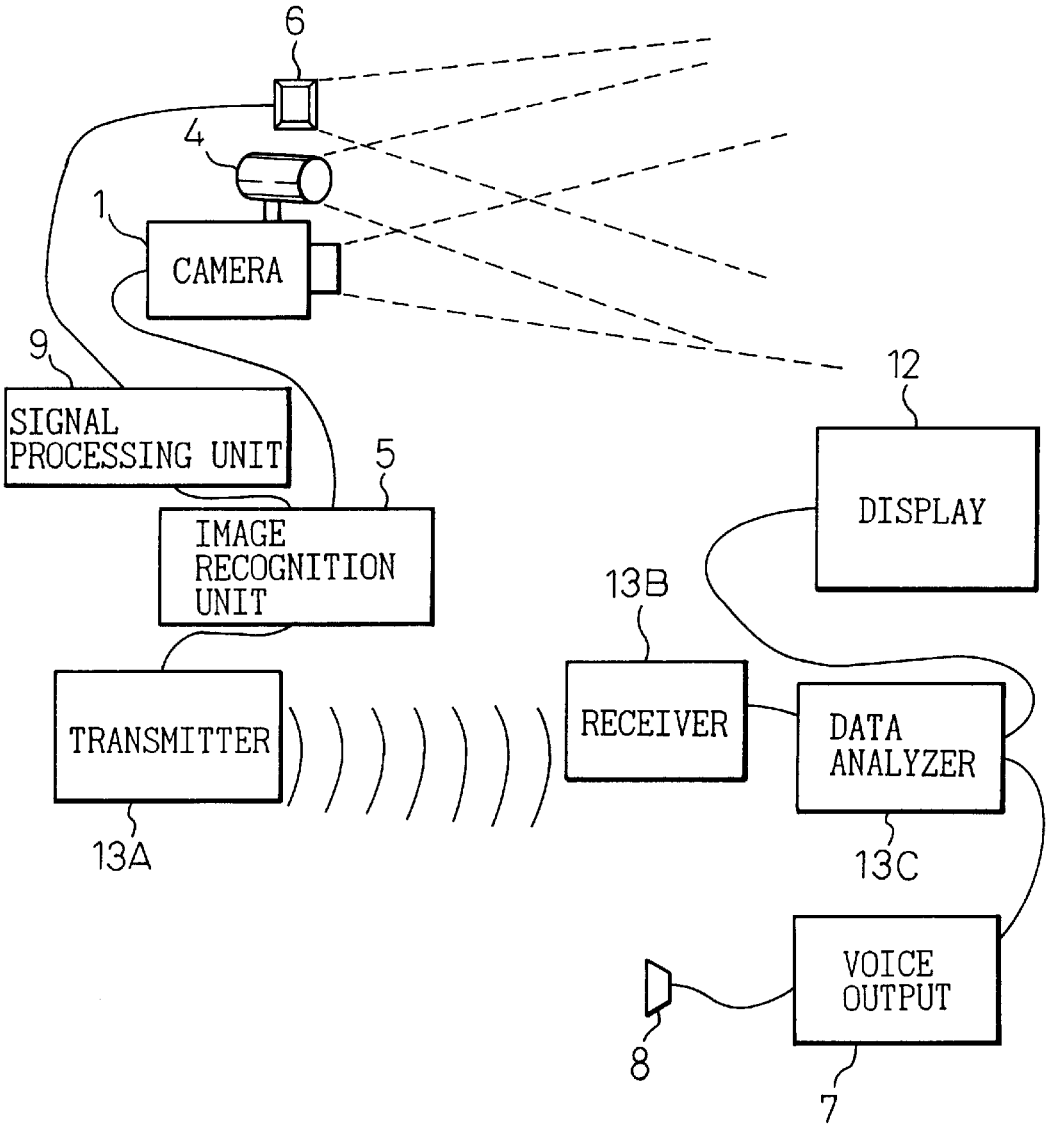
FIG. 13 is a block diagram of the configuration of a 13th embodiment of the present invention.

As shown in FIG. 13, the system for assisting the traffic safety of vehicles according to the 13th embodiment of the present invention is provided with, in addition to the components of the 12th embodiment shown in FIG. 12, a radar (radar type vehicle information detecting means) 6 for emitting a radar wave to an object moving on the road approaching the intersection and obtaining the information of the position and speed of the moving object from the reflected wave, a voice output means comprised of a voice output unit 7 and speaker 8, and a signal processing unit 9 for receiving the output signal of the radar 6 and transmitting the information of the position and speed of the moving object to the image recognizing means 5. The communication control means 13A, 13B, and 13C display the information of the position and speed of the moving object detected by the radar 6 on the screen of the display means 12.

The data analyzer 13C may be provided at the transmitter 13A side instead of the receiver 13B side as shown in FIG. 11 to FIG. 13.

The communication control means having the controller 3 shown in FIG. 1 to FIG. 6 and the transmitter 13A and receiver 13B shown in FIG. 7 to FIG. 13 has a not shown CPU, RAM, floppy disk drive, keyboard, CRT, printer interface, communication interface, etc. These are connected to enable two-way communication through a bus line (not shown). Further, the controller 3 communication control means have magnetic disks storing programs for executing the display functions for display on the display board 2 and display 12, respectively.

The processing of the program stored in the storage medium of the present invention will be explained in brief below. The controller 3 or communication control means of the present invention is a computer system provided with a central processing unit (CPU) and a storage medium, for example, a RAM or magnetic disk. This computer system is provided with a floppy disk drive for a portable storage medium (not shown) such as a floppy disk.

The program for making the computer execute the above display function stored in a floppy disk or other portable storage medium by a predetermined operation is read by a floppy disk drive and loaded into the RAM. Of course, the operator may write the above program directly into the RAM of the computer system by a keyboard or other input means. Alternatively, the above program stored in a RAM (not shown) as an example of the storage medium placed in a computer system (not shown) of one client may be loaded into the RAM of another computer system through a LAN (local area network) or terminal unit (not shown). Then, the program loaded in the RAM is executed as needed by processing by the CPU of the computer system.

Next, examples of the arrangement of the components of the present invention at the intersection will be explained with reference to FIG. 14 to FIG. 20.

Figure 14:
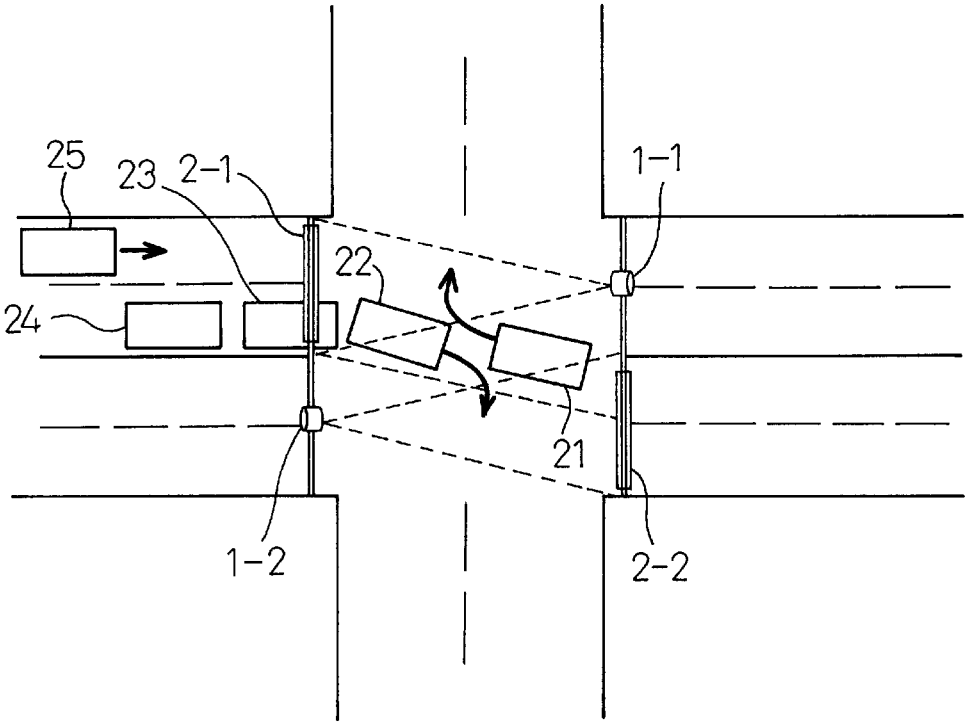
FIG. 14 is a view of a first arrangement of the components of the present invention at an intersection.

FIG. 14 is a view of the arrangement, at the intersection, of the components of the system for assisting the traffic safety of vehicles according to the first embodiment of the present invention. The cameras 1-1 and 1-2, the display boards 2-1 and 2-2, and the not shown controllers 3-1 and 3-2 are provided. For the driver of the right turning vehicle 21, the camera 1-1 monitors the right turning vehicle 22 on the oncoming lane of the right turning vehicle 21, the vehicles 23 and 24 waiting to turn right, and the vehicle 25 proceeding straight. The image data obtained by the camera 1-1 is displayed on the display board 2-1. Due to this display, the vehicles 23 and 24 waiting to turn right and the vehicle 25 proceeding straight, which are at blind spots and therefore cannot be seen by the driver of the right turning vehicle 21, can be notified to the driver. In the embodiment of the present invention, the CCD camera or CMOS camera, which is sensitive to the near infra-red region, is used as the near infra-red camera. Conversely, for the driver of the right turning vehicle 22, the camera 1-2 monitors the right turning vehicle 21 on the oncoming lane of the right turning vehicle 22. The image obtained by the camera 1-2 is displayed at the display board 2-2.

Figure 15:
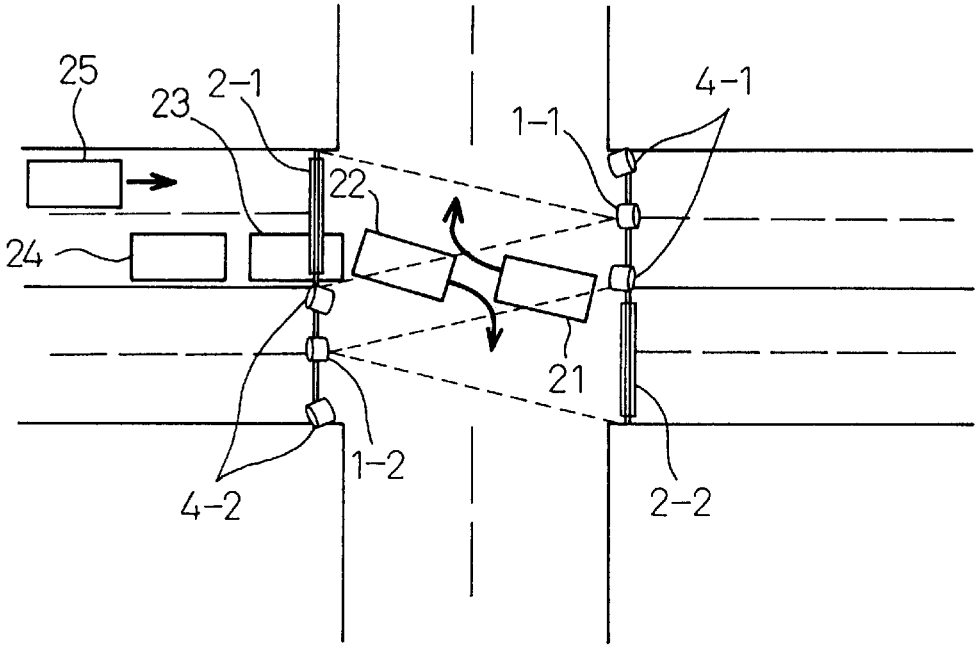
FIG. 15 is a view of a second arrangement of the components of the present invention at an intersection.

FIG. 15 is a view of the arrangement, at the intersection, of the components of the system for assisting the traffic safety of vehicles according to the second embodiment of the present invention shown in FIG. 2. The embodiment differs from the example of arrangement shown in FIG. 14 in the point that the near infra-red illumination units 4-1 and 4-2 are further provided. The near infra-red illumination units 4-1, 4-2 enable monitoring by illuminating the oncoming lane when the lighting is insufficient for the cameras 1-1 and 1-2 to monitor the oncoming lanes of the right turning vehicles 21 and 22 due to night or rain etc. Since near infra-red light is emitted, the drivers of the vehicles 23 and 24 waiting to turn right and the vehicle 25 proceeding straight are not temporarily blinded by the light.

Figure 16:
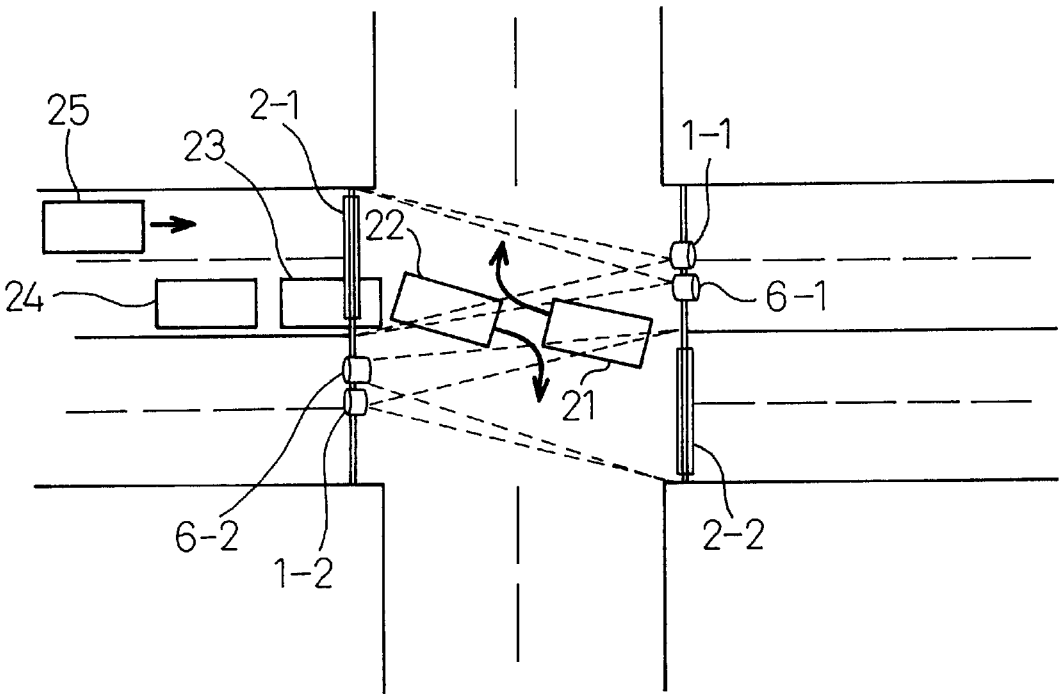
FIG. 16 is a view of a third arrangement of the components of the present invention at an intersection.

FIG. 16 is a view of the arrangement, at the intersection, of the components of the system for assisting the traffic safety of vehicles according to the fifth embodiment of the present invention shown in FIG. 5. The embodiment differs from the example of arrangement shown in FIG. 14 in the point that the radars 6-1 and 6-2 are further provided. The information of the position and speed of the vehicle 25 proceeding straight approaching the intersection from the radars 6-1 and 6-2 using millimeter waves or lasers etc. is measured by a not shown signal processing unit. The image obtained from the cameras 1-1 and 1-2 and the letters and graphic information obtained from the radar 6-1 and 6-2 and the signal processing unit are combined and displayed on the display boards 2-1 and 2-2.

Figure 17:
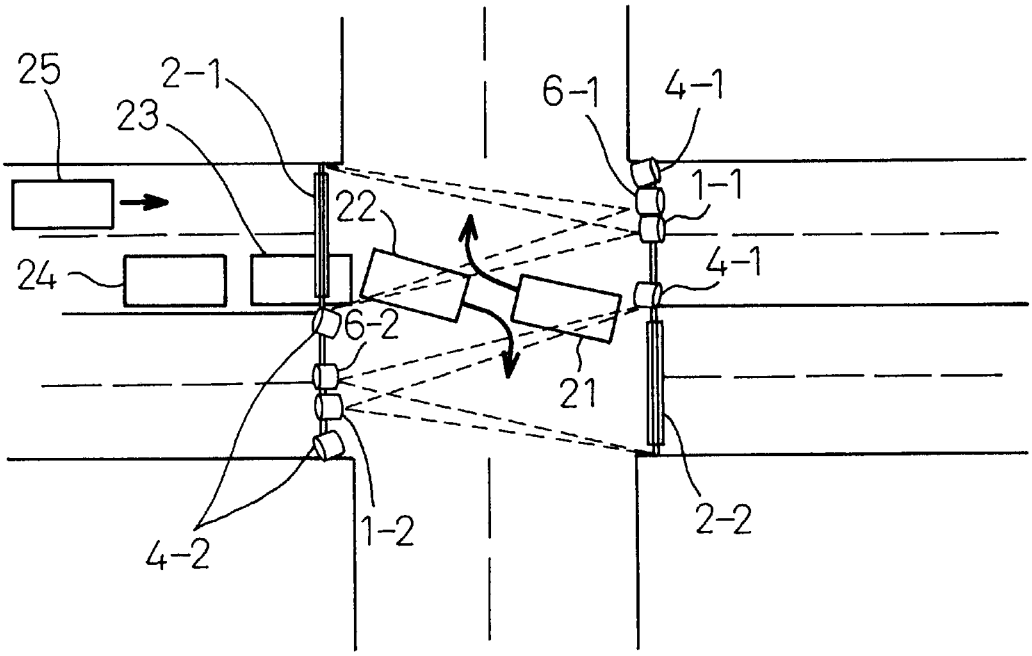
FIG. 17 is a view of a fourth arrangement of the components of the present invention at an intersection.

FIG. 17 is a view of the arrangement, at the intersection, of the components of the system for assisting the traffic safety of vehicles according to the sixth embodiment of the present invention shown in FIG. 6. The embodiment differs from the example of arrangement shown in FIG. 16 in the point that the near infra-red illumination units 4-1 and 4-2 are further provided.

Figure 18:
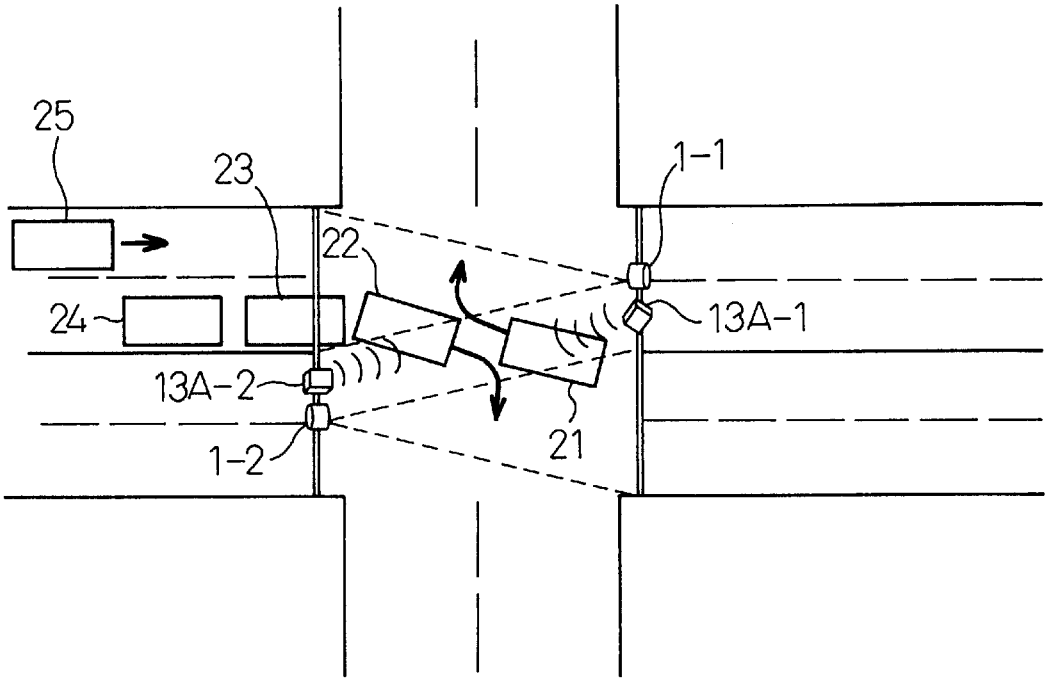
FIG. 18 is a view of a fifth arrangement of the components of the present invention at an intersection.

FIG. 18 is a view of the arrangement, at the intersection, of the components of the system for assisting the traffic safety of vehicles according to the seventh embodiment of the present invention shown in FIG. 7. The cameras 1-1 and 1-2 and the transmitters 13A-1 and 13A-2 are provided. Receivers (not shown) and displays (not shown) are mounted in the right turning vehicles 21 and 22. For the driver of the right turning vehicle 21, the camera 1-1 monitors the right turning vehicle 22 on the oncoming lane of the right turning vehicle 21, the vehicles 23 and 24 waiting to turn right, and the vehicle 25 proceeding straight. The image data obtained by the camera 1-1 is received by the receiver (not shown) in the right turning vehicle 21 through the transmitter 13A-1 and is displayed on the screen of the display in the right turning vehicle 21. Due to this display, the vehicles 23 and 24 waiting to turn right and the vehicle 25 proceeding straight, which are at blind spots and therefore cannot be seen by the driver of the right turning vehicle 21, can be notified to the driver. In the embodiment of the present invention, the CCD camera or CMOS camera is used as the camera. Conversely, for the driver of the right turning vehicle 22, the camera 1-2 monitors the right turning vehicle 21 on the oncoming lane of the right turning vehicle 22. The image obtained by the camera 1-2 is received at the receiver (not shown) in the right turning vehicle 22 through the transmitter 13A-2 and is displayed on the screen of the display in the right turning vehicle 22.

Figure 19:
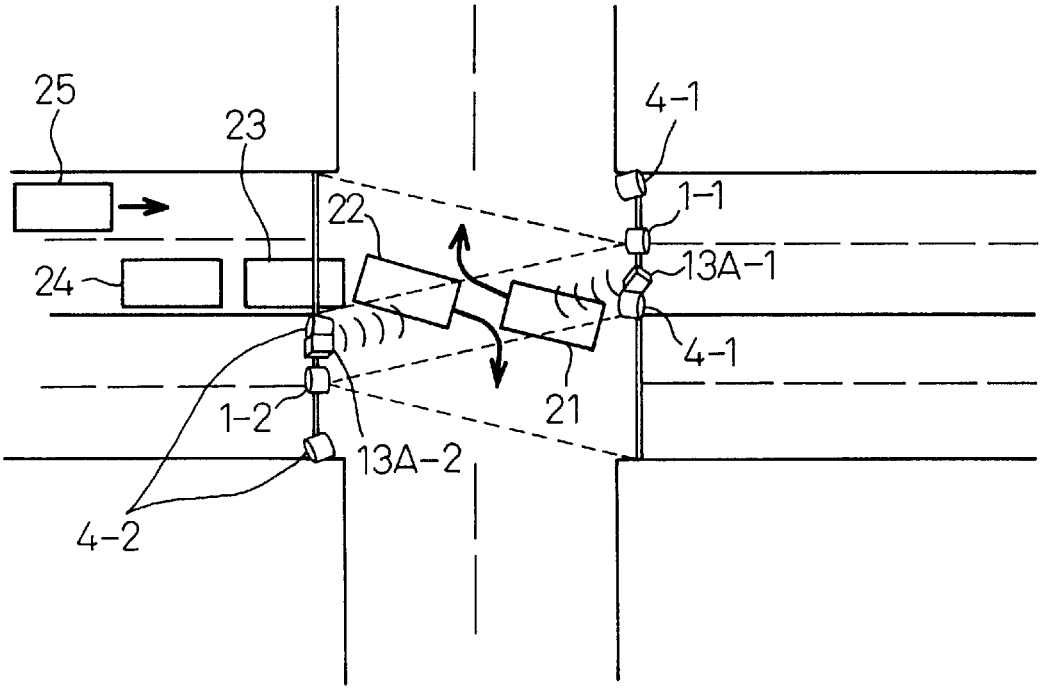
FIG. 19 is a view of a sixth arrangement of the components of the present invention at an intersection.

FIG. 19 is a view of the arrangement, at the intersection, of the components of the system for assisting the traffic safety of vehicles according to the eighth embodiment of the present invention shown in FIG. 8. The embodiment differs from the example of arrangement shown in FIG. 18 in the point that the near infra-red illumination units 4-1 and 4-2 are further provided. The near infra-red illumination units 4-1, 4-2 enable monitoring by illuminating the oncoming lane when the light is insufficient for the cameras 1-1 and 1-2 to monitor the oncoming lanes of the right turning vehicles 21 and 22 at night or in the rain etc. Since near infra-red light is emitted, the drivers of the vehicles 23 and 24 waiting to turn right and the vehicle 25 proceeding straight are not temporarily blinded by the beams.

Figure 20:
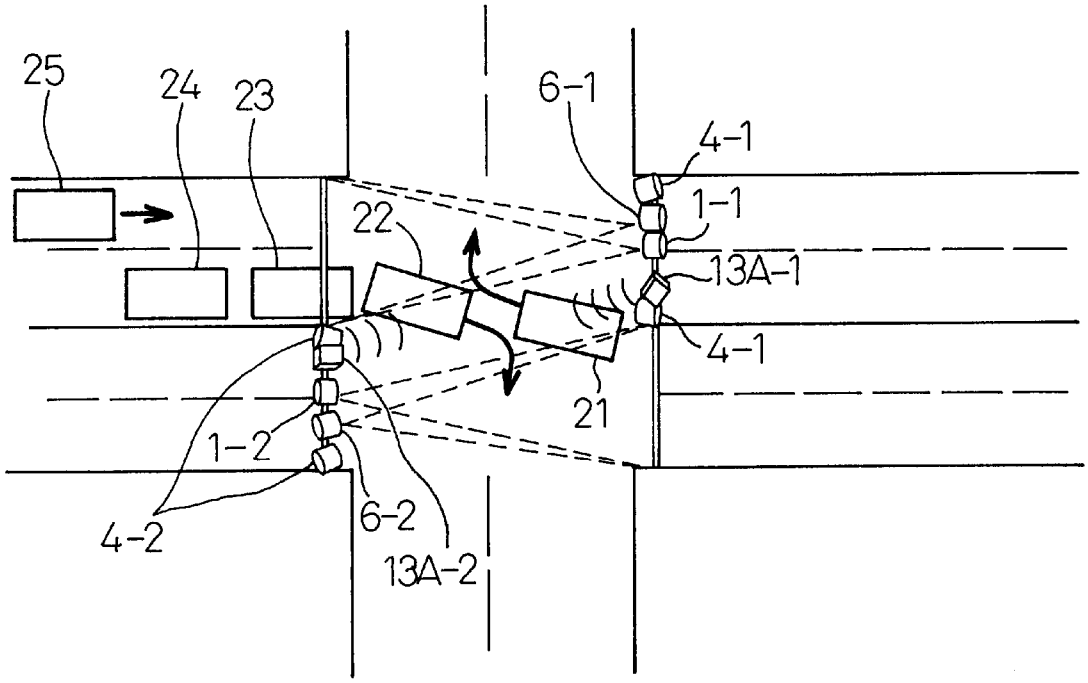
FIG. 20 is a view of a seventh arrangement of the components of the present invention at an intersection.

FIG. 20 is a view of the arrangement, at the intersection, of the components of the system for assisting the traffic safety of vehicles according to the 13th embodiment of the present invention shown in FIG. 13. The embodiment differs from the example of arrangement shown in FIG. 19 in the point that the radars 6-1 and 6-2 are further provided. The information of the position and speed of the vehicle 25 proceeding straight approaching the intersection from the radars 6-1 and 6-2 using millimeter waves or lasers etc. is measured by a not shown signal processing unit. The image obtained from the cameras 1-1 and 1-2 and the letters and graphic information obtained from the radar 6-1 and 6-2 and the signal processing unit are combined by a not shown image recognition unit and displayed on the screens of the displays in the right turning vehicles 21 and 22.

Figure 21:
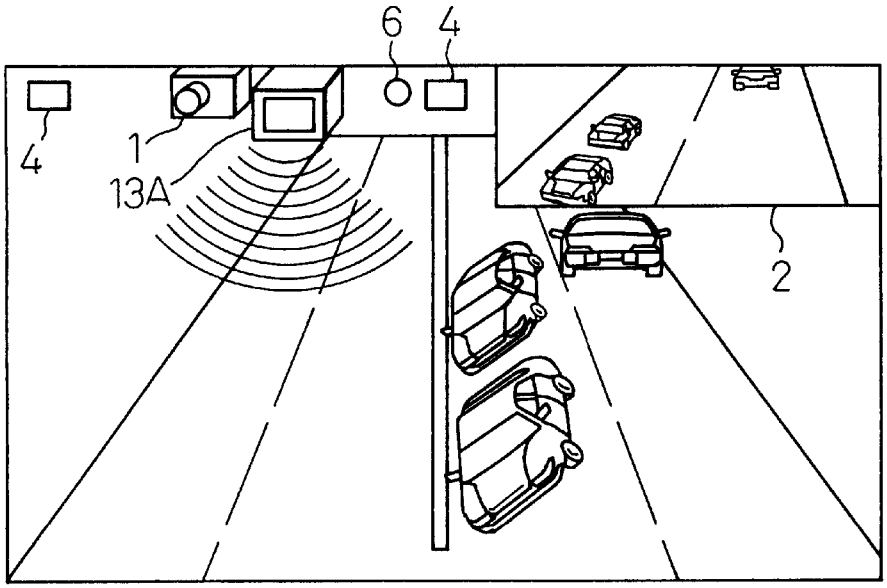
FIG. 21 is a view of an oncoming lane and display board as seen from a vehicle making a right turn at an intersection.

FIG. 21 is a view of an oncoming lane and display board as seen from a right turning vehicle at an intersection. The display board 2 shown at the top right displays two vehicles waiting to make a right turn on the oncoming lane and one vehicle proceeding straight. Further, it is learned from FIG. 21 that the camera 1, transmitter 13A, near infra-red illumination unit 4, and radar 6 are placed on the line where the oncoming lane and intersection intersect.

Figure 22:
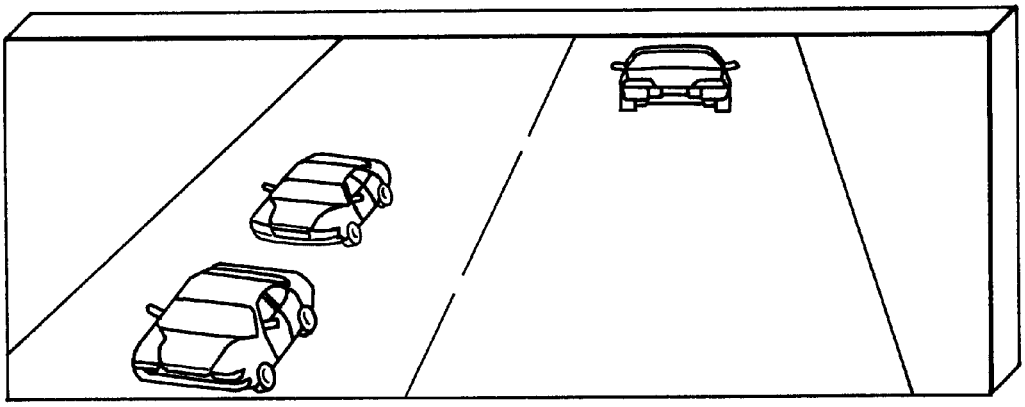
FIG. 22 is a view of a first example of a display screen.

FIG. 22 is a view of a first example of the display screen. The image shown at the top right of FIG. 21 for example is displayed on the screen of the display board or vehicle-mounted display.

Figure 23:
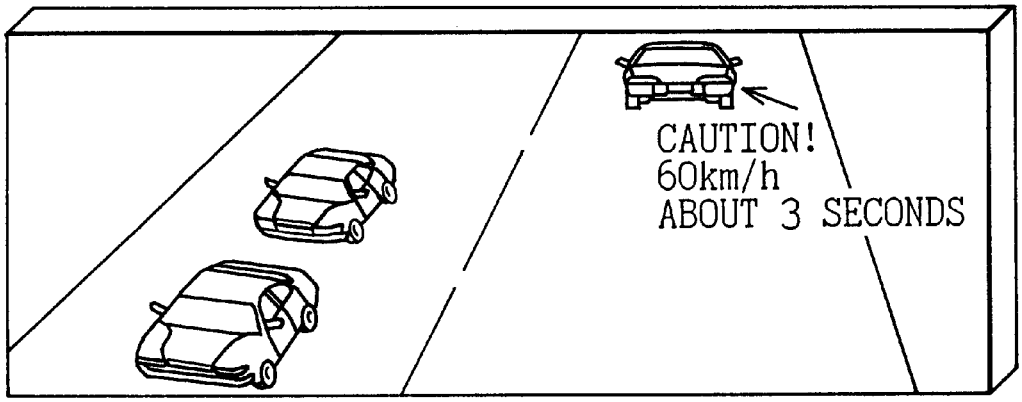
FIG. 23 is a view of a second example of a display screen.

FIG. 23 is a view of a second example of the display screen. The speed 60 km/h of a vehicle proceeding straight measured by radar and warning information of about 3 seconds to reaching the intersection are displayed as text data. When this is judged as being hazardous to the right turning vehicle, the driver may be notified of this by surrounding the vehicle proceeding straight by for example a flashing red circle to emphasize it.

Figure 24:
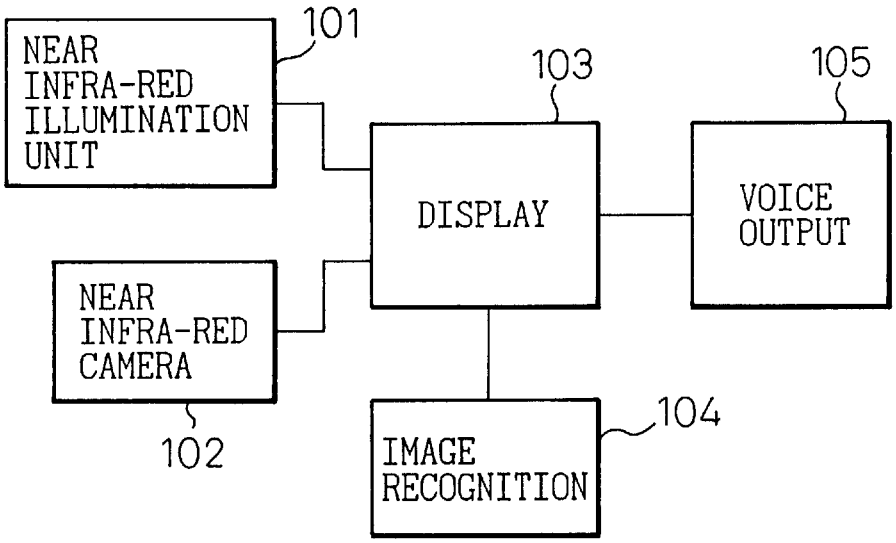
FIG. 24 is a block diagram of the configuration of one aspect of a system for assisting the traffic safety of vehicles improving the front or rear visibility of a vehicle.

FIG. 24 is a block diagram of the configuration for explaining systems for assisting the traffic safety of vehicles of the 14th to 17th embodiments (front) or 19th to 22nd embodiments (rear) for improving the front or rear visibility of the vehicle.

As shown in FIG. 24, the system for assisting the traffic safety of vehicles according to the 14th embodiment of the present invention is provided with a near infra-red illumination unit 101 provided near the light source for the high beam of the headlight illuminating the front of the vehicle so as to emit light to the area illuminated by the high beam, a near infrared camera 102 provided at the front end of the vehicle so as to monitor the road in front of the vehicle illuminated by the near infra-red illumination unit 101, and a display means 103 for displaying the image of the road in front of the vehicle obtained by the near infrared camera 102. The near infra-red light from the near infra-red illumination unit 101 is not emitted as continuous light, but is emitted as discontinuous light according to a flashing circuit (not shown) provided in synchronization with the shutter timing of the near infra-red camera 102.

The system for assisting the traffic safety of vehicles according to the 15th embodiment of the present invention is provided with, in addition to the system of the 14th embodiment, an image recognizing means 104 for recognizing a moving object on the road in front of the vehicle based on the image obtained by the near infra-red camera 102. Further, the display means 103 displays an image of the moving object recognized by the image recognizing means 104 on the screen of the display means 103.

The system for assisting the traffic safety of vehicles according to the 16th embodiment of the present invention is provided with, in addition to the system of the 15th embodiment, a display means 103 which analyzes the position and speed of the moving object based on the data of the image of the moving object recognized by the image recognizing means 104 and displays information drawing the attention of the driver on a screen of the display means 103 when judging that the moving object is liable to contact the vehicle. The image recognizing means 104 detects the moving object from the image obtained by the near infra-red camera 102 by for example an edge detection technique.

The distance from the vehicle to the moving object on the road in front of or in the rear of the vehicle may be found by providing two near infra-red cameras 102 at the left and right, monitoring the moving object by these cameras, and measuring the distance from the parallax.

The system for assisting the traffic safety of vehicles according to the 17th embodiment of the present invention is provided with, in addition to the system of the 16th embodiment, a voice output means 105 mounted in the vehicle for voice output of information drawing the attention of the driver.

The systems for assisting the traffic safety of vehicles according to the 19th to 22nd embodiment of the present invention differ in the following three points from the corresponding 14th to 17th embodiments:

1. The near infra-red illumination unit 101 is replaced by a near infra-red illumination unit provided near the light source of the tail light illuminating the road to the rear of the vehicle so as to illuminate the road to the rear of the vehicle.
2. The near infra-red camera 102 is replaced by a near infra-red camera provided at the rear end of the vehicle so as to monitor the road to the rear of the vehicle illuminated by the near infra-red illumination unit.
3. The display means 103 differs in the point of displaying the image of the road to the rear of the vehicle obtained by the near infra-red camera 102.

Figure 25:
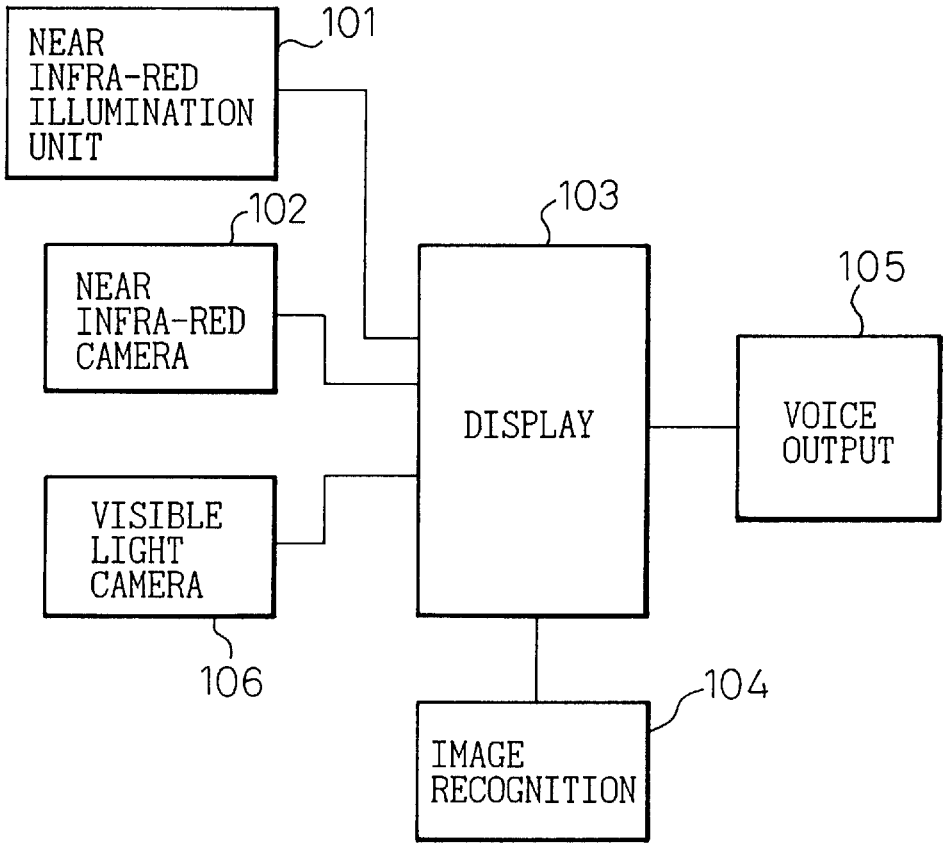
FIG. 25 is a block diagram of the configuration of another aspect of a system for assisting the traffic safety of vehicles improving the front or rear visibility of a vehicle.

FIG. 25 is a block diagram of the configuration of a system for assisting the traffic safety of vehicles of the 18th embodiment (front) or 23rd embodiment (rear) for improving the front or rear visibility of the vehicle.

As shown in FIG. 25, the system for assisting the traffic safety of vehicles according to the 18th embodiment of the present invention is provided with, in addition to the components of the system of the 17th embodiment shown in FIG. 24, a visible light camera 106 provided at the front end of the vehicle for monitoring the road to the front of the vehicle illuminated by the high beam of the headlight. Further, the display means 103 displays a color image of the road to the front of the vehicle obtained by the visible light camera 106.

As shown in FIG. 25, the system for assisting the traffic safety of vehicles according to the 23rd embodiment of the present invention differs from the system of the 18th embodiment in that it improves the rear visibility of the vehicle instead of improving the front visibility of the vehicle. That is, the system of the 23rd embodiment is provided with a visible light camera 106 provided at the rear end of the vehicle for monitoring the road to the rear of the vehicle illuminated by the near infra-red illumination unit 101 provided at the rear of the vehicle. Further, the display means 103 displays a color image of the road to the rear of the vehicle obtained by the visible light camera 106.

The distance from the vehicle to the moving object on the road in front of or in the rear of the vehicle may be found by providing two visible light cameras 106 at the left and right, monitoring the moving object by these cameras, and measuring the distance from the parallax.

The display means 103 shown in FIG. 24 and FIG. 25 has a not shown CPU, RAM, floppy disk drive, keyboard, CRT, print interface, communications interface, etc. which are connected through a bus line (not shown) to enable two-way communication with each other. Further, the display means 103 has a magnetic disk storing the program for executing the display function for display on a screen.

The processing of the program stored in the storage medium of the present invention will be explained in brief below. The display means 103 of the present invention is a computer system provided with a central processing unit (CPU) and a storage medium, for example, a RAM or magnetic disk. This computer system is provided with a floppy disk drive for a portable storage medium (not shown) such as a floppy disk.

The program for making the computer execute the above display function stored in a floppy disk or other portable storage medium by a predetermined operation is read by a floppy disk drive and loaded into the RAM. Of course, the operator may write the above program directly into the RAM of the computer system by a keyboard or other input means. Alternatively, the above program stored in a RAM (not shown) as an example of the storage medium placed in a computer system (not shown) of another client may be loaded into the RAM of concerned computer system through a LAN (local area network) or terminal unit (not shown). Then, the program loaded in the RAM is executed as needed by processing by the CPU of the computer system.

Figure 26:
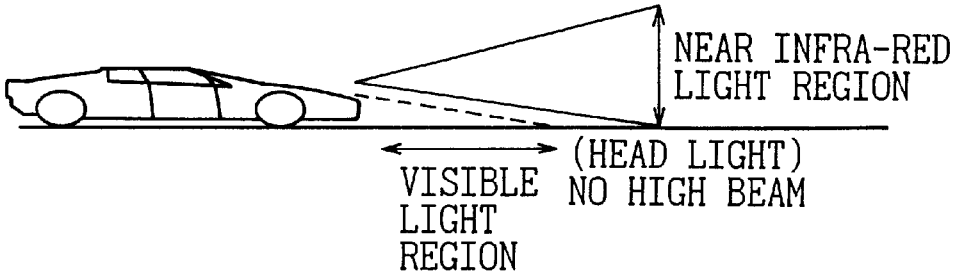
FIG. 26 is a view explaining a system for assisting the traffic safety of vehicles improving the front visibility of a vehicle according to the present invention.

FIG. 26 is a view explaining a system for assisting the traffic safety of vehicles for improving the front visibility of the vehicle according to the present invention. In the systems for assisting the traffic safety of vehicles according to the 14th to 18th embodiments of the present invention, the near infra-red region of the road to the front of the vehicle illuminated by the near infra-red illumination unit 101 corresponds to the region of the road to the front of the vehicle illuminated by the high beam of the headlight. The near infra-red camera 102 monitors the near infra-red region to obtain an image.

Figure 27:
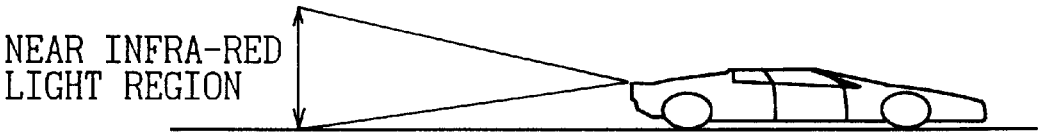
FIG. 27 is a view explaining a system for assisting the traffic safety of vehicles improving the rear visibility of a vehicle according to the present invention.

FIG. 27 is a view explaining a system for assisting the traffic safety of vehicles for improving the rear visibility of the vehicle according to the present invention. The system for assisting the traffic ;safety of vehicles according to the 19th to 23rd embodiments monitors the near infra-red region of the road to the rear of the vehicle illuminated by the near infra-red illumination unit 101 by the near infra-red camera 102 to obtain an image.

Figure 28:
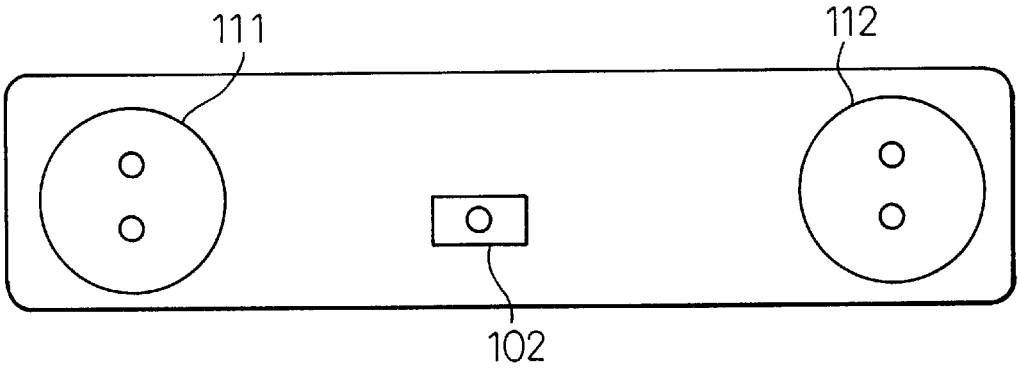
FIG. 28 is a view of an example of a front grille of a vehicle according to a first example of the present invention.

FIG. 28 is a view of a front grille of a vehicle according to a first example of the present invention. Illumination lamps 111 and 112 are provided at the left and right of the front grille. A near infra-red camera 102 passing only infra-red and cutting the visible light is provided at the center.

Figure 29:
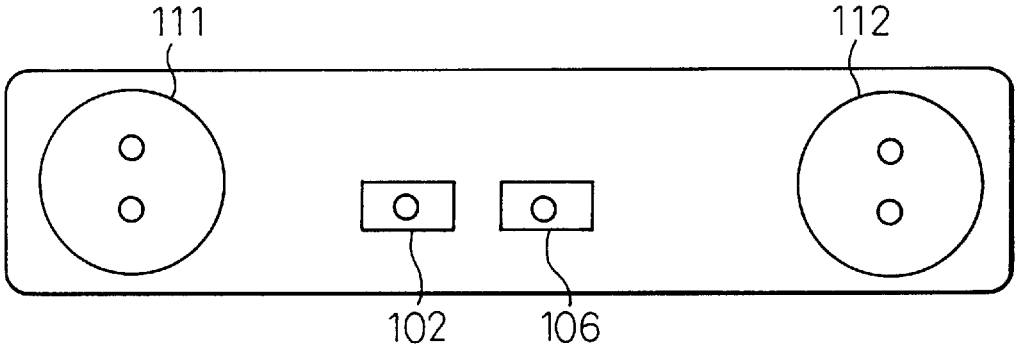
FIG. 29 is a view of an example of a rear grille of a vehicle according to a second example of the present invention.

FIG. 29 is a view of a front grille of a vehicle according to a second example of the present invention. Illumination lamps 111 and 112 are provided at the left and right of the front grille. A near infra-red camera 102 passing only infra-red light and cutting visible light and a visible light camera 106 passing only visible light and cutting infra-red light are provided at the center.

Figure 30:
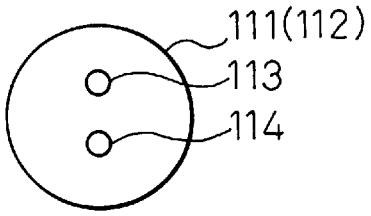
FIG. 30 is a view of a headlight in the front grille shown in FIG. 28.

FIG. 30 is a view of a headlight in the front grille shown in FIG. 28. As shown in FIG. 30, in the headlight 111 (112), a near infra-red lamp 113 is provided at the position of the high beam light source of the headlight and a visible light lamp 114 is provided at the position of the low beam light source of the headlight. The high beam light source may be left as it is at the position of the high beam light source of the headlight, while the near infra-red lamp 113 may be provided near the position of the high beam light source of the headlight.

An explanation was given using FIG. 28 to FIG. 30 of the arrangement of a headlight, near infra-red camera 102, and visible light camera 106 for improving the front visibility of a vehicle at a front grille of a vehicle according to the present invention, but the arrangement of the tail light, near infra-red camera 102, and visible light camera 106 for improving the rear visibility of the vehicle is similar to the above and therefore its illustration is omitted.

Summarizing the effect of the invention, according to the present invention, it is possible to improve the visibility of a driver and therefore reduce the occurrence of traffic accidents at intersections by displaying without blind spots or giving a voice warning of the state of the oncoming vehicles to a driver of a right turning vehicle, in particular, at an intersection.

Further, as explained above, according to the present invention, since the front and rear visibility of the vehicle is improved, it is possible to reduce the occurrence of traffic accidents.

While the invention has been described by reference to specific embodiments chosen for purposes of illustration, it should be apparent that numerous modifications could be made thereto by those skilled in the art without departing from the basic concept and scope of the invention.

What is claimed is:

1. A system for assisting the traffic safety of vehicles comprising:

an imaging device that monitors an oncoming lane of a road at an intersection;

a radar device that obtains a position and a speed of an object moving on the road approaching the intersection;

a display board placed at a position above the road that is visible to a driver of an approaching vehicle; and a control device that controls the display board to show an image of the oncoming lane of the road obtained by the imaging device and an alarm information obtained by analyzing the position and the speed of the object moving on the road approaching the intersection.

2. A system for assisting the traffic safety of vehicles as set forth in claim 1, further comprising:

a near infra-red illuminating device that illuminates the oncoming lane of the road.

3. A system for assisting the traffic safety of vehicles as set forth in claim 1, further comprising:

an image recognizing device that recognizes an object approaching the intersection based on the image of the oncoming lane of the road obtained by the imaging device, and the control device displays the image of the moving object recognized by the image recognizing device on the display board.

4. A system for assisting the traffic safety of vehicles as set forth in claim 1, further comprising:

a voice output placed near the display board that outputs the alarm information.

5. A system for assisting the traffic safety of vehicles as set forth in claim 1, wherein the control device analyzes a position and a speed of the moving object and displays information drawing the attention of the driver to the display board when a determination is made that the moving object is liable to contact the vehicle.

6. A system for assisting the traffic safety of vehicles as set forth in claim 5, filter comprising:

a voice output device that outputs information drawing the attention of the driver.

7. A system for assisting the traffic safety of vehicles comprising:

an image device mounted at or near an intersection that monitors an oncoming lane of a road;

a radar device that obtains a position and a speed of an object moving on the road approaching the intersection;

a display device with a screen mounted in the vehicle; and a communications control device that sends radio communication between the imaging device and the display device and that controls a display of the image of the oncoming lane and an alarm information obtained by analyzing the position and the speed of the object moving on the road approaching the intersection of the road obtained from the imaging device on the screen of the display device.

8. A system for assisting the traffic safety of vehicles as set forth in claim 7, further comprising a near infra-red illuminating device that illuminates the oncoming lane of the road.

9. A system for assisting the traffic safety of vehicles as set forth in claim 7, further comprising:

an image recognizing device for recognizing an object moving on the road approaching the intersection based on the image of the road obtained by the imaging device, and the communication control device displays the image of the moving object recognized by the image recognizing device on the display device.

10. A system for assisting the traffic safety of vehicles as set forth in claim 7, wherein the communication control device analyzes the position and speed of the moving object detected by the radar type vehicle information detecting device and displays information drawing the attention of the driver to the moving object on the display device when it is judged that the moving object is liable to contact the vehicle.

11. A system for assisting the traffic safety of vehicles as set forth in claim 10, further comprising:

a voice output device mounted in the vehicle for voice output of information.

12. A system for assisting the traffic safety of vehicles comprising:

a near infra-red illumination unit provided at or near a light source for a high beam of a headlight illuminating the road in front of the vehicle that emits near-infra red light to substantially the area illuminated by the high beam;

a near infra-red camera provided at the front end of the vehicle that monitors the road in front of the vehicle illuminated by the near infra-red illumination unit; and a display device that displays the image of the road in front of the vehicle obtained by the near infra-red camera.

13. A system for assisting the traffic safety of vehicles as set forth in claim 12, further comprising:

an image recognizing device that recognizes an object in front of the vehicle based on the image obtained by the near infra-red camera, and the display device displays the image of the object recognized by the image recognizing device.

14. A system for assisting the traffic safety of vehicles as set forth in claim 13, wherein the display device analyzes a position and a speed of the object and displays information drawing the attention of the driver to the screen of the display device when a determination is made that the object is liable to contact the vehicle.

15. A system for assisting the traffic safety of vehicles as set forth in claim 12, further comprising:

a voice output device mounted in the vehicle for voice output of the information.

16. A system for assisting the traffic safety of vehicles as set forth in claim 13, further comprising:

a visible light camera placed at the front end of the vehicle and monitoring the road in front of the vehicle illuminated by the high beam of the headlight, and the display device displays a color image of the road in front of the vehicle obtained from the visible light camera.

17. A system for assisting the traffic safety of vehicles comprising:

a near infra-red illumination unit provided at or near the light source of a tail light that illuminates the road to the rear of a vehicle;

a near infra-red camera provided at the rear end of the vehicle that monitors the road to the rear of the vehicle illuminated by the near infra-red illumination unit; and a display device that displays an image of the road to the rear of the vehicle obtained from the near infra-red camera.

18. A system for assisting the traffic safety of vehicles as set forth in claim 17, further comprising:

an image recognizing device that recognizes a moving object at the rear of the vehicle based on the image obtained by the near infra-red camera, and the display device displays the image of the moving object recognized by the image recognizing device on the screen of the display device.

19. A system for assisting the traffic safety of vehicles as set forth in claim 18, wherein the display device analyzes a position and a speed of the moving object based on the data of the image of the moving object recognized by the image recognizing device and displays information drawing the attention of the driver to the screen of the display device when a determination is made that the moving object is liable to contact the vehicle.

20. A system for assisting the traffic safety of vehicles as set forth in claim 14, further comprising:

a voice output device mounted in the vehicle for voice output of the information.

21. A system for assisting the traffic safety of vehicles as set forth in claim 17, further comprising:

a visible light camera placed at the rear end of the vehicle that monitors the road to the rear of the vehicle illuminated by the near infra-red illumination unit, and the display device displays a color image of the road to the rear of the vehicle obtained by the visible light camera.

22. A computer readable storage medium used in a system for assisting the traffic safety of vehicles including an imaging device that monitors an oncoming lane of a road at an intersection, a radar device that obtains a position and a speed of an object on the road approaching the intersection and a display board provided at a position above the road that is visible to a driver of an approaching vehicle, wherein the storage medium stores a program for making a computer function as a control device that displays an image of the oncoming lane of the road obtained by the imaging device on the display board and an alarm information obtained by analyzing the position and the speed of the object moving on the road approaching the intersection.

23. A computer readable storage medium used in a system for assisting the traffic safety or vehicles including an imaging device mounted at or near an intersection that monitors an oncoming lane of a road, a radar device that obtains a position and a speed of an object moving on the road approaching the intersection and a display device with a screen mounted in a vehicle, wherein the storage medium stores a program that makes a computed function as a communication control device for radio communication between the imaging device and the display device and that controls a display of the image of the oncoming lane and an alarm information obtained by analyzing the position and the speed of the object moving on the road approaching the intersection of the road obtained by the imaging device on the screen of the display device.

24. A computer readable storage medium used in a system for assisting the traffic safety of vehicles including a near infra-red illumination unit provided at or near the position of a high beam of a headlight illuminating the road in front of the vehicle that emits near-infra red light to substantially the area illuminated by the high beam and a near infrared camera provided at the front end of the vehicle that monitors the road in front of the vehicle illuminated by the near infra-red illumination unit, wherein the storage medium stores a program that makes a computer function as a display device that displays an image of the road in the front of the vehicle obtained from the near infra-red camera.

25. A computer readable storage medium used in a system for assisting the traffic safety of vehicles including a near infra-red illumination unit provided at or near a tail light illuminating the road to the rear of the vehicle that emits near infra-red light to the road to the rear of the vehicle and a near infra-red camera provided at the rear end of the vehicle that monitors the road to the rear of the vehicle, wherein the storage medium stores a program that makes a computer function as a display device that displays an image of the road to the rear of the vehicle obtained from the near infra-red camera.

26. A method for assisting the traffic safety of vehicles comprising:

capturing an image of at least an oncoming lane for a vehicle making a turn at an intersection;

obtaining a position and a speed of an object moving on the road approaching the intersection;

displaying the image and an alarm information obtained by analyzing the position and the speed of the object moving on the road approaching the intersection at a position above the road leading up to the intersection in a manner visible to a driver of the vehicle.

27. The method of claim 26, wherein the oncoming lane is illuminated using at least one of visible light, radar waves and near infrared waves.

28. The method of claim 26, further comprising recognizing an object moving on the road approaching the intersection based on the image captured and displaying the image of the moving object recognized by the image recognizing device.

29. The method of claim 28 further comprising analyzing and displaying the position and speed of the moving object.

30. The method of claim 29, wherein the analyzing and displaying includes displaying at least one of the object detected's position and the speed of the moving object in such a way that the attention of the driver is drawn to the image when a determination is made that the moving object is liable to contact the vehicle.

31. The method of claim 29, further comprising using sound to notify the driver of information gathered by the imaging device.

32. A method for assisting the traffic safety of vehicles comprising:

capturing an image of at least an oncoming lane for a vehicle making a turn at an intersection;

obtaining a position and a speed of an object moving on the road approaching the intersection;

displaying the image and an alarm information obtained by analyzing the position and the speed of the object moving on the road approaching the intersection on a display device mounted in the vehicle leading up to the intersection in a manner visible to a driver of the vehicle.

33. The method of claim 32, further comprising illuminating the oncoming lane with at least one of visible light, radar waves and near infrared waves.

34. The method of claim 33, further comprising recognizing and displaying an object moving on the road approaching the intersection based on the image captured.

35. The method of claim 34 wherein the recognizing and displaying includes displaying the position and speed of the moving object.

36. The method of claim 32 further comprising:

displaying the at least one of the detected object's position and the speed in such a way that the attention of the driver is drawn to the image when a determination is made that the moving object is liable to contact the vehicle.

37. The method of claim 26, further comprising using sound to notify the driver of information gathered by the imaging device.

38. A system for assisting the traffic safety of vehicles comprising:

an imaging device that monitors an oncoming lane of a road at an intersection;

an image recognition circuit that recognizes an object moving on the road approaching the intersection based on an image of the road obtained by the imaging device;

a radar device that obtains a position and a speed of the object moving on the road approaching the intersection;

a display board placed at a position above the road that is visible to a driver of an approaching vehicle; and a control device that controls the display board to show an image of the road obtained by the imaging device, the object recognized by the image recognition circuit and an alarm information obtained by analyzing the position and the speed of the object moving on the road approaching the intersection.

39. A system for assisting the traffic safety of vehicles as set forth in claim 38, further comprising a near infra-red illuminating device that illuminates the oncoming lane of the road.

40. A system for assisting the traffic safety of vehicles as set forth in claim 39, further comprising:

a voice output device, mounted in the vehicle that voice outputs information.

41. A system for assisting the traffic safety of vehicles as set forth in claim 38, wherein the control device analyzes the position and speed of the moving object detected by the radar device and displays information drawing the attention of the driver to the moving object on the display board when it is judged that the moving object is liable to contact the vehicle.

42. A system for assisting the traffic safety of vehicles as set forth in claim 41, further comprising:

a voice output device, mounted in the vehicle that voice outputs information.

43. A system for assisting the traffic safety of vehicles as set forth in claim 38, further comprising:

a voice output device, mounted in the vehicle that voice outputs information.

44. A system for assisting the traffic safety of vehicles as set forth in claim 2, further comprising:

a voice output device, mounted in the vehicle that voice outputs information.

45. A system for assisting the traffic safety of vehicles comprising:

an image device mounted at or near an intersection that monitors an oncoming lane of a road;

an image recognition circuit that recognizes an object moving on the road approaching the intersection based on an image of the road obtained by the imaging device;

a radar device that emits a radar wave and obtains a position and a speed of an object moving on the road approaching the intersection from the reflected wave;

a display device with a screen mounted in the vehicle; and a communications control device that sends radio communication between the imaging device and the display device and that controls a display of the image of the oncoming lane and an alarm information obtained by analyzing the position and the speed of the object moving on the road approaching the intersection of the road obtained from the imaging device on the screen of the display device.

46. A system for assisting the traffic safety of vehicles as set forth in claim 45, further comprising a near infra-red illuminating device that illuminates the oncoming lane of the road.

47. A system for assisting the traffic safety of vehicles as set forth in claim 45, wherein the communication control device analyzes the position and speed of the moving object detected by the radar device and displays information drawing the attention of the driver to the moving object on the display device when it is judged that the moving object is liable to contact the vehicle.

48. A system for assisting the traffic safety of vehicles as set forth in claim 45, further comprising:

a voice output device, mounted in the vehicle that voice outputs information.

* * * * *